US005957220A

United States Patent [19]

Coffman et al.

[11] Patent Number: 5,957,220

[45] Date of Patent: Sep. 28, 1999

[54] PERCUSSION DRILL ASSEMBLY

[75] Inventors: James E. Coffman, Tulsa; Paul W. Crites, Broken Arrow, both of Okla.; Paul B. Campbell; Ewald H. Kurt, both of Roanoke, Va.

[73] Assignee: Dresser-Rand Company, Corning, N.Y.

[21] Appl. No.: 08/723,768

[22] Filed: Sep. 30, 1996

Related U.S. Application Data

[60] Provisional application No. 60/005,695, Oct. 17, 1995.

[51] Int. Cl.[6] ..... B25D 17/06

[52] U.S. Cl. ..... 173/91; 173/73; 173/79; 175/296

[58] Field of Search ..... 173/91, 17, 137, 173/138, 79, 80, 73; 175/296, 19; 74/57

[56] References Cited

U.S. PATENT DOCUMENTS

| | | | |
|---|---|---|---|
| 2,389,711 | 11/1945 | Armentrout | 255/27 |
| 2,852,230 | 9/1958 | Garrison | 173/79 |
| 2,947,519 | 8/1960 | Feucht | 255/4.4 |
| 3,193,024 | 7/1965 | Cleary | 173/17 |
| 3,316,613 | 5/1967 | Habib | 29/26 |
| 3,568,783 | 3/1971 | Chenowith et al. . | |
| 3,620,312 | 11/1971 | Krasnoff | 173/138 |
| 3,792,616 | 2/1974 | Wentzel | 74/57 |
| 3,807,512 | 4/1974 | Pogonowski | 175/296 |
| 4,111,271 | 9/1978 | Perkins | 175/297 |
| 4,192,219 | 3/1980 | Krasnoff et al. | 91/276 |
| 4,417,860 | 11/1983 | Justice | 417/415 |

(List continued on next page.)

FOREIGN PATENT DOCUMENTS

| | | |
|---|---|---|
| 569204 | 1/1959 | Canada . |
| 0081897 | 6/1983 | European Pat. Off. . |
| 0088705 | 9/1983 | European Pat. Off. . |
| 810952 | 3/1981 | U.S.S.R. . |
| 1645490 | 4/1991 | U.S.S.R. . |
| 1649090 | 5/1991 | U.S.S.R. . |
| 857173 | 12/1960 | United Kingdom . |
| 962127 | 6/1964 | United Kingdom . |
| 8803220 | 5/1988 | WIPO . |

OTHER PUBLICATIONS

Temple–Ingersoll "Electric–Air" Rock Drills, Form No. 4209, Third Edition, May, 1917, pp. 1–16.

Temple–Ingersoll "Electric–Air" Rock Drills, Form No. 4023, Second Edition Revised, May, 1922, pp. 1–4.

Temple–Ingersoll "Electric–Air" Rock Drills, Form No. 4024, Second Edition, Mar. 1916, 1922, pp. 1–4.

*Primary Examiner*—Peter Vo
*Assistant Examiner*—James P. Calve
*Attorney, Agent, or Firm*—Haynes and Boone, LLP

[57] ABSTRACT

A compressor piston divides a first compartment into two compression chambers, while a hammer piston divides a second compartment into two drive chambers, each of the compression chambers being connected to a respective one of the drive chambers to form a closed fluid system wherein reciprocation of the compressor piston-causes cyclic compression and expansion of the fluid in the compression chambers and thus in the drive chambers, to effect a cyclic impacting of the hammer piston with a bit adapter connected to the drill bit. A mud motor rotates a shaft to drive an oscillator which reciprocates the compressor piston. The oscillator can comprise roller elements in the compressor piston in engagement with canted grooves in the shaft. While drilling mud drives the motor and then passes downwardly to flush the drill bit and the borehole, the drilling mud is isolated from the closed fluid system. The bit adapter slides axially, so that when the drill bit is not in contact with a borehole bottom, the bit adapter and the hammer piston move downwardly to a position where the two drive chambers are in direct communication such that the reciprocation of the compressor piston does not actuate the hammer piston. Each of the pistons is an annular piston having a bleed passageway between its chambers, permitting the chambers to equalize when the pistons are stationary. The superatmospheric pressure is such that the hammer piston reciprocates at a frequency within ±20% of natural resonant frequency.

4 Claims, 8 Drawing Sheets

U.S. PATENT DOCUMENTS

| | | | |
|---|---|---|---|
| 4,425,835 | 1/1984 | Krasnoff | 91/317 |
| 4,446,929 | 5/1984 | Pillow | 173/17 |
| 4,450,920 | 5/1984 | Krasnoff et al. | 173/80 |
| 4,660,658 | 4/1987 | Gustafsson | 175/296 |
| 4,694,911 | 9/1987 | Kennedy | 173/62 |
| 4,771,835 | 9/1988 | Eaton | 175/92 |
| 4,790,390 | 12/1988 | Sweeny | 173/17 |
| 4,914,637 | 4/1990 | Goodsman | 367/83 |
| 4,921,052 | 5/1990 | Rear | 173/78 |
| 4,921,056 | 5/1990 | Ennis | 175/92 |
| 4,932,483 | 6/1990 | Rear | 175/296 |
| 5,014,796 | 5/1991 | Gustafsson | 175/296 |
| 5,030,071 | 7/1991 | Simpson | 418/13 |
| 5,107,944 | 4/1992 | Gustafsson | 175/296 |
| 5,113,950 | 5/1992 | Krasnoff | 173/13 |
| 5,156,223 | 10/1992 | Hipp | 175/296 |
| 5,207,283 | 5/1993 | Lay | 175/296 |
| 5,318,140 | 6/1994 | Ekwall et al. | 175/296 |
| 5,396,965 | 3/1995 | Hall et al. | 173/73 |
| 5,592,852 | 1/1997 | Parsons | 74/57 |
| 5,662,180 | 9/1997 | Coffman | 175/296 |

31
34
15
32
36
35
33
51
52
46
48
38
49
41
44
43
16
37
42
16
40
41
38
48
53
55
54
56
56
17
47
58
57

PERCUSSION DRILL ASSEMBLY

RELATED APPLICATION

This application claims the benefit of prior filed copending U.S. Provisional Application No. 60/005,695, filed Oct. 17, 1995.

FIELD OF THE INVENTION

This invention pertains to a percussion drill assembly, and more particularly to a downhole, liquid driven, fluid operated, percussion drill assembly for drilling a borehole in an earth formation and the operation thereof.

BACKGROUND OF THE INVENTION

When drilling a borehole in rock formations with a conventional tricone roller drill bit, the rate of penetration of the formations has been found to be proportional to the weight, or downward thrust, placed on the drill bit. However, when drilling through rock formations which lie at an acute angle to the longitudinal axis of the existing borehole, unequal resistance to the penetration by the drill bit causes the direction of the drilling to deviate from the existing borehole axis, with this deviation also being proportional to the weight on the drill bit. As there is normally a limit placed on acceptable deviations of the borehole axis, the thrust on the drill bit is backed off until an acceptably small deviation is attained. Of course, this results in a reduced penetration rate and higher drilling costs.

It has been known for some time that repetitive impact blows on a roller drill bit will increase the penetration rate of the drill bit and that, because of the short duration of each impact blow, any deviation of the borehole is minimized. Impact blows, therefore, can be used as a substitute for part of the weight on the drill bit.

The Temple-Ingersoll "Electric Air" percussive rock drill, which was employed in the early part of the twentieth century, comprised a hammer piston having first and second ends positioned in two separate air chambers, two compressor pistons with each compressor piston being connected to a respective one of the air chambers to form two closed air systems, a crankshaft which actuated the two compressor pistons at a 180° phase difference, an electric motor for driving the crankshaft, and a drill bit threadedly connected to one end of the impact piston. However, all of this equipment, other than the drill bit, was located above the earth surface, and the drilling depths achievable by this equipment were very shallow.

Pneumatic downhole percussion drills, which have been employed for over twenty-five years in borehole drilling, use a gas to reciprocate a hammer piston so that the hammer piston delivers repetitive impact forces to an anvil surface on a roller drill bit, improving the penetration rate of the drill bit while at the same time minimizing the deviation of the borehole. Unfortunately, only about six percent of all boreholes drilled in rock formations are suitable for the use of air as the medium to flush drilling debris from the borehole during the drilling operation. Thus, drilling mud is employed as the flushing fluid in over ninety percent of all boreholes drilled in rock formations. Consequently, the concept of extending the percussion advantage in air-flushed drilling to mud-flushed drilling has been an enduring goal in the borehole drilling industry.

One recent effort to employ a pneumatic percussion drill in a mud-flushed borehole is disclosed in Kennedy, U.S. Pat. No. 4,694,911, wherein an air actuated annular impact piston is contained in a drilling assembly having an axial mud flow path. This is accomplished by employing a special drill string having air intake and air exhaust passageways in the wall of each of the drill pipes in addition to the central mud passageway. The special drill pipe represents a substantial increase in cost, particularly in deep wells, as well as an added difficulty in assuring alignment of the air passageways from one drill pipe to the next drill pipe in the drill string.

Various attempts to develop a percussion drill for drilling mud-flushed boreholes utilizing the drilling mud as the only fluid supplied to the drill assembly have employed a direct mud drive approach. In the direct mud drive approach, the drilling mud is selectively directed to a first chamber containing the back end of a downhole piston to drive the piston downwardly to strike an anvil associated with the drill bit and thus impart an impact force to the drill bit, and then the drilling mud is selectively directed to a second chamber containing the front end of the piston to drive the piston back to the top of its stroke. The drilling mud exhausted from the piston chambers can then be utilized to flush debris from the drill bit and the borehole. A valve assembly or a combination of ports in a sliding element, either a sleeve or a piston, is used to switch the drilling mud flow from the back end to the front end of the piston and then from the front end to the back end of the piston in each impact cycle. One such direct mud drive is disclosed in Hall et al, U.S. Pat. No. 5,396,965.

There are several disadvantages to the direct mud drive approach that, collectively, have hindered the success of various attempts to date to commercially employ this approach in a mud operated impact drill. First, despite a filtering operation, the drilling mud generally contains some abrasive material such as sand, which causes erosion at the exposed edges and in the clearance spaces of the piston and the valves of the impact drill, resulting in a short operating life and high replacement costs. Second, the impact between the piston and the drill bit takes place in a mud bath, that is, each of the hammer end of the piston and the anvil surface on the drill bit is totally immersed in drilling mud prior to and at the point of impact. This means that a portion of the impact force is dissipated in squeezing mud out from between the hammer face and the anvil face prior to and at the moment of the impact. In addition, this high pressure squeezing can cause pitting to occur on the faces of the piston and the drill bit, again resulting in high replacement costs. Third, as the borehole becomes deeper, the back pressure against which the drilling mud must be exhausted, at the end of each piston stroke, increases. In turn, this reduces the pressure drop across the piston, which in turn reduces the impact force imparted to the drill bit, which in turn reduces the penetration rate of the drill bit. Fourth, as the pressure and flow rate of the drilling mud are dictated by borehole flushing requirements, the same pressure and flow rate may also be used to drive the piston. This does not provide any latitude to vary the energy or the frequency of the impact blows, as can be required by variations in the rock formations encountered in the borehole.

SUMMARY OF THE INVENTION

It is an object of one aspect of this invention to provide a percussion drill assembly which can be operated in a drilling mud flushed borehole while the percussion components are isolated from the drilling mud.

It is an object of one aspect of this invention to use a first fluid to reciprocate a hammer piston so that the hammer piston delivers repetitive impact forces to an anvil surface on a roller drill bit, improving the penetration rate of the drill bit while at the same time minimizing the deviation of the borehole, while flushing the drill bit and borehole with a different fluid.

It is an object of one aspect of this invention to provide a hammer piston in a closed fluid system in a downhole drill assembly, so that the differential fluid pressure across the hammer piston can be cyclically varied, thereby causing the hammer piston to reciprocate and strike an anvil surface associated with the drill bit, without exposing the hammer piston to the drilling mud which is employed to flush the drill bit and the borehole.

It is an object of one aspect of this invention to provide a compressor piston and a hammer piston in a closed fluid system in a downhole drill assembly, so that the compressor piston can cyclically vary the differential fluid pressure across the hammer piston, thereby causing the hammer piston to reciprocate and strike an anvil surface associated with the drill bit, without exposing either the compressor piston or the hammer piston to the drilling mud which is employed to flush the drill bit and the borehole.

It is an object of one aspect of the present invention to provide a percussion drill assembly wherein the impact piston is deactivated when the drill assembly is not in contact with the bottom of the borehole.

It is an object of one aspect of the present invention to provide a percussion drill which can be operated at a frequency which is within ±20% of a natural resonant frequency.

In accordance with one aspect of the present invention, a percussion drill assembly for drilling a borehole in an earth formation comprises: an elongated housing assembly having one end adapted to removably connect the drill assembly to a drill string, and a second end adapted to receive a drill bit; a compartment formed within the housing assembly; a hammer piston positioned within the compartment for reciprocal motion within the compartment along the longitudinal axis of the compartment, the hammer piston dividing the compartment into a first chamber and a second chamber which are substantially fluidly isolated from each other within the compartment by the presence of the hammer piston; a fluid compressor having a first port in the first chamber and a second port in the second chamber; seals for sealing the first and second chambers and the fluid compressor from fluid communication with any fluid received from the drill string; and a driver mounted in the housing assembly and connected to the fluid compressor to drive the fluid compressor.

In accordance with another aspect of the present invention, a percussion drill assembly for drilling a borehole in an earth formation comprises: an elongated housing assembly having one end adapted to removably connect the drill assembly to a drill string, and a second end adapted to receive a drill bit; first and second compartments formed within the housing assembly; a compressor piston positioned within the first compartment for reciprocal motion within the first compartment along the longitudinal axis of the first compartment, the compressor piston dividing the first compartment into a first chamber and a second chamber which are substantially fluidly isolated from each other within the first compartment by the presence of the compressor piston; a hammer piston positioned within the second compartment for reciprocal motion within the second compartment along the longitudinal axis of the second compartment, the hammer piston dividing the second compartment into a third chamber and a fourth chamber which are substantially fluidly isolated from each other within the second compartment by the presence of the hammer piston; a first passageway providing fluid communication between the first chamber and the third chamber; a second passageway providing fluid communication between the second chamber and the fourth chamber; seals for sealing the first and second compartments and the first and second passageways from fluid communication with any fluid received from the drill string, whereby the first and second compartments and the first and second passageways constitute a closed fluid system; each of the first, second, third, and fourth chambers, and the first and second passageways being filled with a fluid at a superatmospheric pressure; a driver mounted in the housing assembly and connected to the compressor piston to cause reciprocating movements of the compressor piston within the first compartment along the longitudinal axis of the first compartment; wherein, when the drill assembly is being operated to impart an impact force to a drill bit, movement of the compressor piston toward the first chamber increases the pressure of the fluid in the first chamber, in the first passageway, and in the third chamber, thereby causing the movement of the hammer piston toward the fourth chamber; and wherein, when the drill assembly is being operated to impart an impact force to a drill bit, movement of the compressor piston toward the second chamber increases the pressure of the fluid in the second chamber, in the second passageway, and in the fourth chamber, thereby causing the movement of the hammer piston toward the third chamber; whereby a predetermined extent of movement of the hammer piston toward one of the third and fourth chambers can impart an impact force to a drill bit connected to the second end of the housing assembly while the drill assembly is being operated to impart an impact force to the drill bit.

In a presently preferred embodiment, the driver comprises a rotary shaft rotatably mounted in the housing assembly; a mud motor positioned in the housing assembly with the rotor of the mud motor being connected to the rotary shaft via an upper coupling adapter, at least one universal joint, and a flow collar, so that rotation of the rotor causes corresponding rotation of the rotary shaft; and an oscillator element connecting the rotary shaft to the compressor piston such that rotation of the rotary shaft in a single direction causes reciprocating movements of the compressor piston.

In the preferred embodiment, the oscillator comprises a plurality of endless, closed loop grooves formed in the outer surface of the rotary shaft at an acute angle to the shaft axis, and a corresponding plurality of roller elements carried by the inner side wall of the compressor piston so that each roller element extends into a respective one of the endless grooves.

In the preferred embodiment, the rotary shaft is tubularly hollow, the compressor piston is an annular piston positioned about the rotary shaft, and the hammer piston is an annular piston positioned about a tubularly hollow stationary shaft. A motor bypass passageway is provided in the rotor of the mud motor so that the mud motor can be driven by less than the total mud flow through the drill string. Thus, the drilling mud flowing through the mud motor and the motor bypass can pass through the hollow of the rotary shaft and the hollow of the stationary shaft to the drill bit without exposure to the fluid in the first and second compartments. Each of the compressor piston and the hammer piston is encircled by a ring member having a bleed passageway therethrough permitting a small flow of fluid between the respectively associated chambers, whereby the fluid pressures in the associated chambers can equalize when the pistons are stationary.

In the preferred embodiment, the second end of the housing assembly comprises a bit adapter for receiving the drill bit, the bit adapter having an anvil surface exposed to the hammer piston compartment. The bit adapter can slide axially with respect to the remainder of the housing assembly so that the bit adapter can move downwardly with respect to the remainder of the housing assembly when the drill bit is not in contact with a borehole bottom. One of the first and second passageways is constructed such that sufficient fluid communication is established between the two chambers of the hammer piston compartment to prevent reciprocation of the hammer piston when the bit adapter has moved downwardly as a result of the drill bit being out of contact with a borehole bottom.

BRIEF DESCRIPTION OF THE DRAWINGS

Further aspects, objects, and advantages of this invention will become apparent from the following description, taken in conjunction with the accompanying drawings in which.

DETAILED DESCRIPTION

Figure 1:
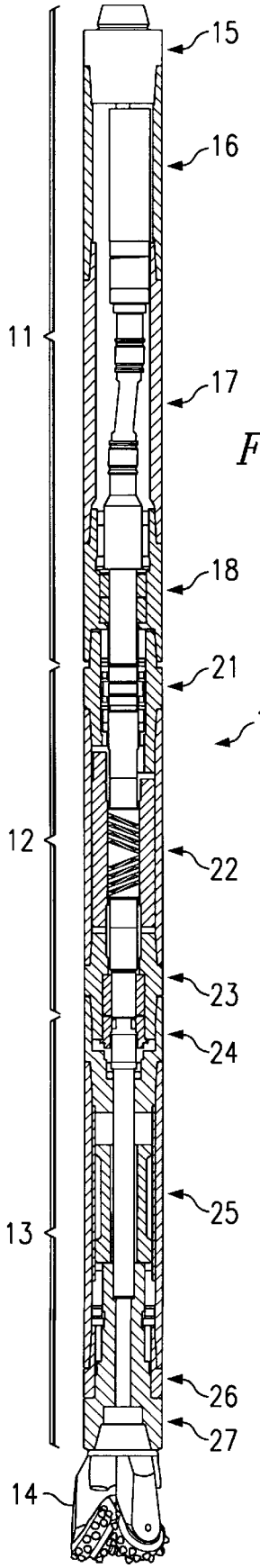
FIG. 1 is a side view of a presently preferred embodiment of a drill assembly in accordance with the invention, showing the various modules connected together in sequence along the longitudinal axis of the assembly.

As shown in FIG. 1, the drill apparatus 10 comprises four major components, or modules, connected in series: a power module 11, a compressor module 12, an impact module 13, and a drill bit 14. The power module 11 comprises a backhead 15, a mud motor segment 16, a drive shaft segment 17, and a bearing segment 18. The compressor module 12 comprises an anchor segment 21, an oscillator segment 22, and a connector segment 23. The impact module 13 comprises a fluid communication segment 24, an impact piston segment 25, a chuck 26, and a bit adapter 27.

A mud motor located in the mud motor segment 16 is rotated by the downwardly flowing drilling mud, supplied via a drill string to the backhead 15, so as to rotate a drive shaft located in the drive shaft segment 17. The rotation of the drive shaft causes the axial reciprocation of a gas compressor piston in the oscillator segment 22, and the compression and expansion of the gas causes the reciprocation of the impact piston located in the impact piston segment 25 for delivering cyclic impacts to the drill bit 14 via the bit adapter 27. The drill bit 14 can be any suitable drill bit, e.g., a tricone rotary drill bit, or a solid percussion drill bit.

Figure 2A:
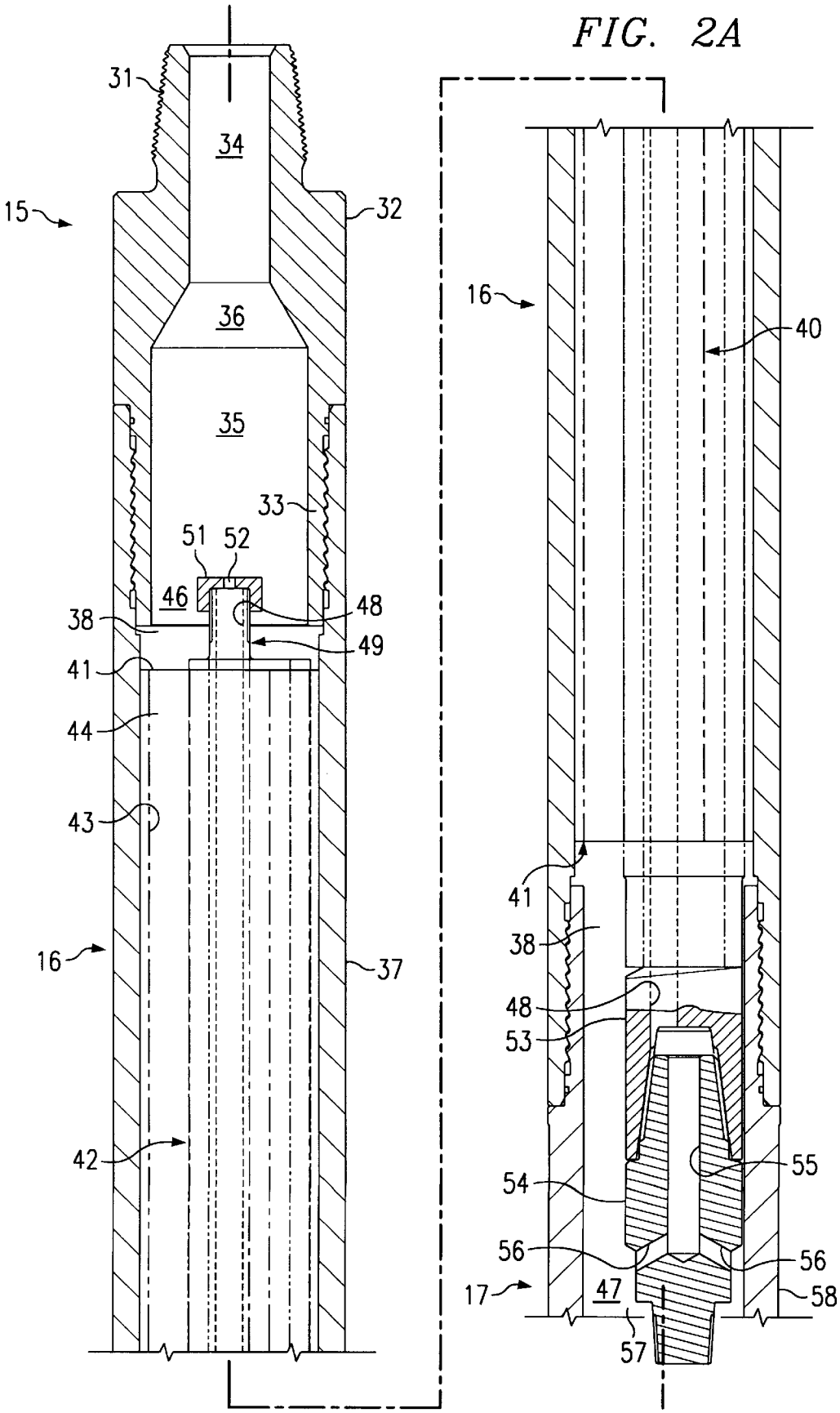
FIG. 2A is a cross-sectional view, taken along the longitudinal axis, of the upper section of the power module of FIG. 1, comprising a backhead and a mud motor segment.

Referring now to FIG. 2A, the upper end portion 31 of the backhead 15 has a reduced external diameter and is provided with external threads for engagement with the internal threads of the box at the lower end of a string of drill pipe (not shown). The intermediate portion 32 of the backhead 15 has an external diameter which can be at least substantially the same as the external diameter of the string of drill pipe. The lower end portion 33 of the backhead 15 has a reduced external diameter and is provided with external threads for engagement with the internal threads in the box at the top end of the mud motor segment 16. The upper end portion 31 has an internal cylindrical passageway 34 which is coaxial with the internal cylindrical passageway 35 in the lower end portion 33 of the backhead 15. The diameter of the passageway 34 is at least substantially the same as that of the internal passageway in the string of drill pipe to which the backhead 15 is joined so that the drilling mud flows downwardly from the interior of the string of drill pipe into the passageway 34 without significant hinderance. The diameter of the passageway 35 is substantially larger than that of the passageway 34, and the passageways 34 and 35 are joined together by an intermediate frustoconical passageway 36 which extends outwardly and downwardly from the diameter of the passageway 34 to the diameter of the passageway 35.

Figure 3:
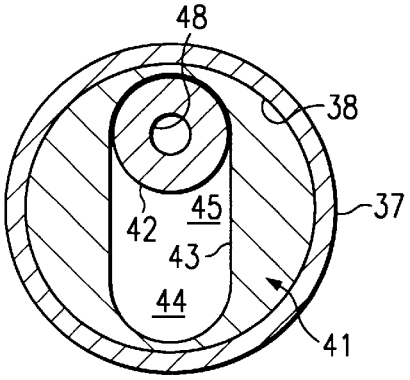
FIG. 3 is a cross-sectional view through the mud motor segment of FIG. 1.

Referring to FIGS. 2A and 3, the mud motor segment 16 comprises a tubular housing 37 having a chamber 38 extending longitudinally from the top end of the housing 37 to the bottom end of the housing 37. The diameter of the chamber 38 is slightly larger than the internal diameter of the passageway 35 of the backhead 15. A progressing cavity motor 40 is positioned within the chamber 38 and comprises a stator 41 and a rotor 42. In general, the stator 41 will have a cylindrical exterior configuration, conforming to the interior surface of the housing 37, and a multi-lobal interior configuration resulting from a plurality of helical grooves formed in the interior surface 43 of the stator 41. The rotor 42 has an external helix with a round or cycloidal cross-section, while the internal design of the stator 41 has one more helix than the rotor 42. While examples of the ratio of the rotor lobes to the stator lobes include 1:2, 3:4, 4:5, 7:8, 8:9, etc., the ratio of the rotor lobes to the stator lobes in the illustrated embodiment is 1:2. Any suitable means can be provided to secure the stator 41 to the tubular housing 37 so that the stator 41 is stationary with respect to the tubular housing 37. The rotor 42 is positioned within the longitudinally extending cavity 44 of the stator 41 and is rotated with respect to the stator 41 by the passage of drilling mud downwardly through the space 45 between the rotor 42 and the stator 41. The turning of the helical rotor 42 within the elongated cavity 44 of the helical stator 41 forms sealed cavities which contain pockets of the drilling mud. As the rotor 42 turns with respect to the stator 41, these mud filled cavities progress from the inlet 46 of the motor 40 to the outlet 47 of the motor 40. The pitch length of the stator helix is equal to the pitch length of the rotor multiplied by the ratio of the number of stator lobes to the number of rotor lobes. Increasing the number of lobes, while maintaining the stator-to-rotor lobe ratio, lowers the rotor speed and increases the torque within the same physical space. The mud motor 40 has the necessary longitudinal length for the desired number of stages. While any suitable number of stages can be employed, a mud motor with fourteen stages has been found to be particularly suitable for achieving a satisfactory normal life. A rotational speed in the range of about 600 to about 1800 rpm is generally considered suitable, with the normal rotational speed being in the range of about 600 to about 1200. Progressing cavity motors are available from Moyno Oilfield Products Division, Fluids Handling Group, Robbins & Myers, Inc.

The rotor 42 has a bypass passageway 48 which extends longitudinally therein from the inlet 46 of the motor 40 to the outlet 47 of the motor 40, and preferably is substantially coaxial with the rotor 42. Thus, part of the high pressure drilling mud being supplied through the drill string passes between the stator 41 and the rotor 42, while the remainder of the drilling mud passes through the passageway 48, thus bypassing the motor 40. In a presently preferred embodiment, the top end portion 49 of the rotor 42 has a reduced diameter and external threads, so that a threaded choke 51, having a central orifice 52, can be inserted through the passageways 34, 36, and 35 and connected to the rotor 42, thereby changing the ratio of the flow rate of the drilling mud through the space between the stator 41 and the rotor 42 to the flow rate of the drilling mud through the bypass passageway 48. In contrast to the customary location of a flow orifice at the outlet 47 of the motor 40, the location of the choke 51 at the inlet 46 of the motor 40 and the configuration of the backhead 15 permits a choke 51 to be removed and a new choke 51 to be mounted on the rotor 42, without the necessity of disassembling the housing 37 from the drive shaft segment 17.

The lower end of the rotor 42 is an internally threaded box 53, which receives the externally threaded upper end of the upper coupling adapter 54. The upper end of the adapter 54 has an axially extending passageway 55 which is in fluid communication with the bypass passageway 48. The lower end of the adapter 54 has an externally threaded reduced portion for connection to the upper end of a universal joint assembly 60 (FIG. 2B) located in the drive shaft segment 17. The lower end of the adapter 54 is solid, but an intermediate portion of the adapter 54 is provided with a plurality of spaced apart passageways 56 which extend outwardly and downwardly from the lower end of axial passageway 55 to the portion of the annular space 57 between the adapter 54 and the housing 58 of the drive shaft segment 17 which constitutes the outlet 47 of the mud motor 40. Thus, the portion of the drilling mud which has passed through the bypass 48 and the passageway 55 is recombined at the outlet 47 of the mud motor 40 with the portion of the drilling mud which has passed through the space 45 between the rotor 42 and the stator 41. The adapter 54 transfers the rotation of the rotor 42 to the universal joint assembly 60.

Figure 2B:
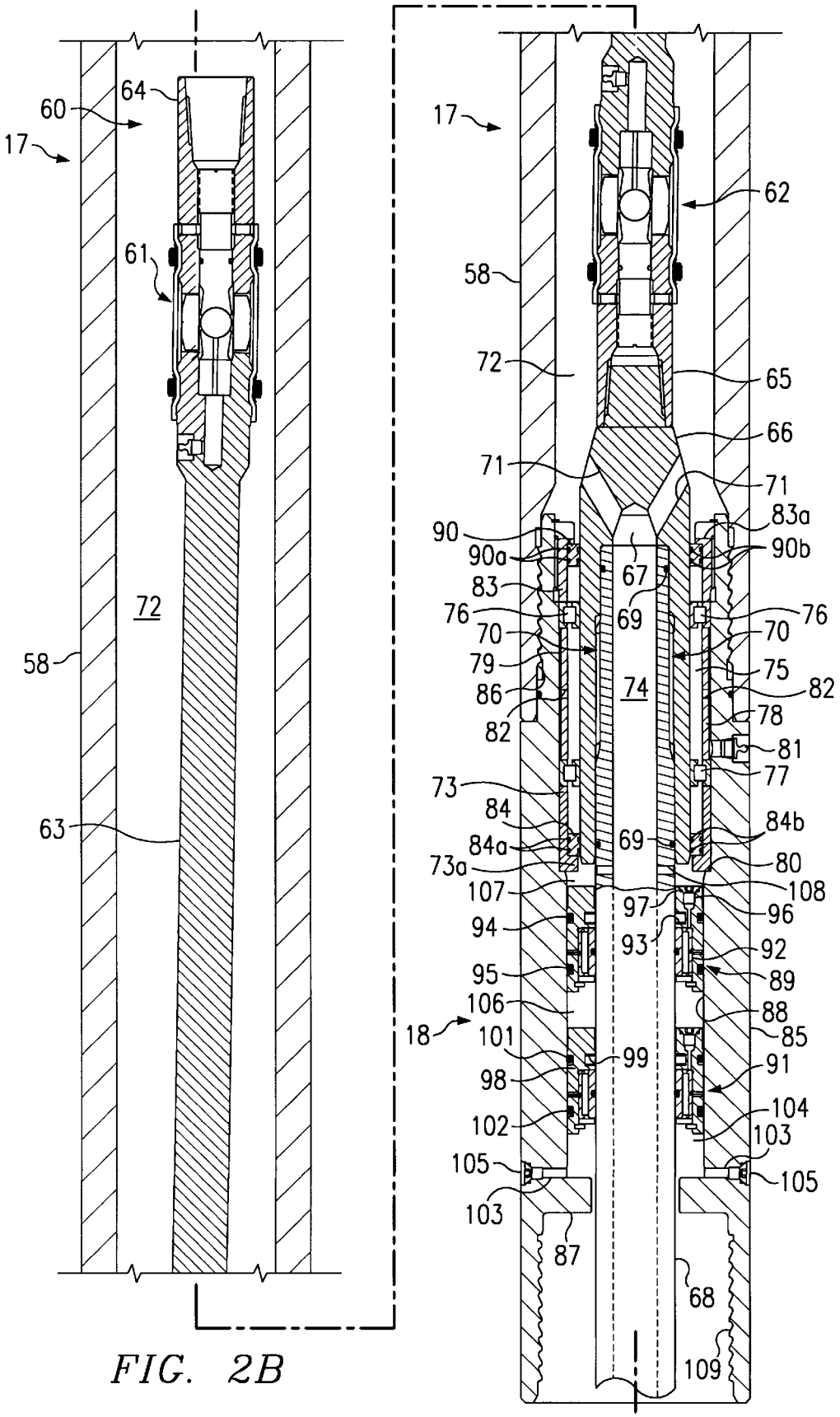
FIG. 2B is a cross-sectional view, taken along the longitudinal axis, of the lower section of the power module of FIG. 1, comprising a drive shaft segment and a bearing segment.

Referring now to FIG. 2B, the universal joint assembly 60 comprises a first universal joint 61 and a second universal joint 62 connected together by a solid drive shaft 63. The top end of the first universal joint 61 is an internally threaded box 64 which is threadedly engaged with the lower end of the adapter 54. The bottom end of the second universal joint 62 is an internally threaded box 65 which is threadedly engaged with the externally threaded top end of the flow collar 66. The lower end of the flow collar 66 has an axially extending chamber 67 into which the upper end of the tubularly hollow rotary shaft 68 extends. A pair of O-rings 69 is positioned between the exterior of the rotary shaft 68 and the interior surface of the chamber 67 to provide a fluid seal therebetween. A plurality of longitudinally extending splines 70 on the exterior of the rotary shaft 68 mate with corresponding longitudinally extending grooves in the interior surface of the flow collar 66 such that the rotation of the flow collar 66 causes a corresponding rotation of the rotary shaft 68. A plurality of spaced apart passageways 71 are formed within the flow collar 66 to extend inwardly and downwardly from the lower end of the annular space 72 between the universal joint assembly 60 and the housing 58 to the top end of the axially extending chamber 67.

The upper end of the housing 85 of the bearing segment 18 has a reduced external diameter with external threads which mate with the internal threads of the box at the lower end of the housing 58. An O-Ring 86 is positioned between the exterior surface of the housing 85 and the interior surface of the housing 58 to provide a fluid seal. The portion of the housing 85 radially adjacent the portion of the flow collar 66 below the inlet openings of passageways 71 and above an internal upwardly facing annular shoulder 80 has an internal diameter which is larger than the external diameter of the flow collar 66 to form an annular cavity 75 between the inner surface of the housing 85 and the outer surface of the flow collar 66. An annular lower bearing retainer 73 is positioned in the annular cavity 75 with the lower end of the lower retainer 73 resting on the shoulder 80.

The upper annular bearing 76 and the lower annular bearing 77 are positioned in the cavity 75, with an annular bearing spacer 78 therebetween, and with the lower annular bearing 77 resting on the lower bearing retainer 73, so as to provide bearing support for the rotating flow collar 66. An annular upper bearing retainer 83 is positioned in the annular cavity 75 with the lower end of the upper retainer 83 resting on the upper annular bearing 76. A portion of the outer surface of the upper retainer 83 is externally threaded for engagement with the internal threads in the radially adjacent inner surface of the housing 85. A retention ring can be placed in an annular groove in the inner surface of the housing 85 immediately above the top end-of the upper retainer 83 to cooperate with the internal shoulder 80 to assure that the lower bearing retainer 73, lower bearing 77, spacer 79, upper bearing 76, and upper bearing retainer 83 are maintained at their desired longitudinal positions.

The lower bearing retainer 73 has a flange **73*a* on its lower end directed radially inwardly toward the flow collar 66, while the upper bearing retainer 83 has a flange 83*a* on its upper end directed radially inwardly toward the flow collar 66. A lower annular buffer ring 84 is loosely positioned between the lower retainer 73 and the flow collar 66, and is limited in its longitudinal movements by the inwardly directed flange 73*a* and the lower bearing 77. Similarly, an upper annular buffer ring 90 is loosely positioned between the upper retainer 83 and the flow collar 66, and is limited in its longitudinal movements by the inwardly directed flange 83*a* and the upper bearing 76. Each of the upper and lower buffer rings 84 and 90 has two annular grooves in its radially innermost surface and two annular grooves in its radially outermost surface. Each of the inner annular grooves in the lower buffer ring 84 contains an annular sealing element 84***a*, while each of the inner annular grooves in the upper buffer ring 90 contains an annular sealing element 90*a*. Each of the sealing elements 84*a* and 90*a* has an interference fit on the flow collar 66, and is free to spin within the respective inner groove of the respective buffer ring 84 or 90, as there is a clearance between the inner groove and the sealing element 84*a* or 90*a* on both sides and on the diameter. Each of the outer annular grooves in the lower buffer ring 84 contains an O-ring 84*b* which is sized 60 as to continuously provide contact with the radially inner surface of the lower retainer ring 73, while each of the inner annular grooves in the upper buffer ring 90 contains an O-ring 90*b* which is sized so as to continuously provide contact with the radially inner surface of the upper retainer ring 83. Each of the buffer rings 84 and 90 is a loose fit with respect to the respective bearing retainer 73 or 83, and is free to float axially in response to pressure changes or leakage.

The outer diameter of the spacer 78 is slightly smaller than the diameter of the radially adjacent inner wall surface of the housing 85 to form an annular gap 79 therebetween. An alemite grease fitting 81 is secured in the outer wall of the housing 85 to permit grease to be injected into the annular gap 79 under pressure. The annular spacer 78 has a plurality of openings 82 extending radially therethrough, providing fluid communication between the gap 79 and the portion of the cavity 75 which is between the spacer 78 and the flow collar 66, thereby permitting grease to flow from the gap 79 to each of the annular bearings 76 and 77.

When filling the bearing cavity with grease, any trapped air can leak around the outside of the sealing elements 84*a* and 90*a* because of the lack of a positive seal by the sealing elements 84*a* and 90*a*. However, when high viscosity grease begins to flow around a sealing element 84*a* or 90*a*, the grease itself will assist in forming a seal so that pumping further quantities of grease into the cavity should force the buffer rings toward their outer extreme longitudinal positions, thus maximizing the grease capacity of the cavity 75. In operation the sealing elements 84*a* and 90*a* will act somewhat like labyrinth seals in limiting the leakage of the grease out of the cavity 75. Since the buffer rings 84 and 90 are free to move axially within their limits, operating mud pressure in the annular space 72 and in the annular pressure equalization chamber 107 (described below) will force the buffer rings 84 and 90 toward each other within the cavity 75 until the mud pressure and the grease pressure are equalized. Therefore, the sealing elements 84*a* and 90*a* will not be exposed to large pressure differences, but will still be effective in retaining grease and in keeping contaminants away from the bearings 76 and 77.

Thus, the buffer rings 84 and 90, with their sealing elements 84*a* and 90*a* and their O-rings 84*b* and 90*b*, effectively close the lower end of the annular chamber 72, so that all of the drilling mud from the outlet 47 of mud motor 40 passes between the adapter 54 and the housing 58 of the drive shaft segment 17, then through the annular space 72, then through the inclined passageways 71 to the chamber 67, and then through the passageway 74 which extends axially through the rotary shaft 68.

The housing 85 has an inwardly directed annular flange 87 which extends radially inwardly toward the rotary shaft 68 so that there is only a small annular gap between the innermost surface of the flange 87 and the exterior surface of the rotary shaft 68. An upper bearing seal assembly 89 and a lower bearing seal assembly 91 are positioned coaxially with the rotary shaft 68 in the cavity 88 between the housing 85 and the rotary shaft 68 above the flange 87. The upper bearing seal assembly 89 comprises an upper shaft annular bearing assembly 92, an upper shaft annular seal 93, the two O-rings 94 and 95 mounted between the upper shaft annular bearing assembly 92 and the housing 85, an oil fill passageway 96 and a fill plug 97. The lower bearing seal assembly 91 comprises a lower shaft annular bearing assembly 98, a lower shaft annular seal 99, and the two O-rings 101 and 102 mounted between the lower shaft annular bearing assembly 98 and the housing 85.

A plurality of oil fill passageways 103 is provided in the wall of the housing 85 in order to permit oil to be injected under pressure into the lower annular oil chamber 104 which is the portion of the cavity 88 between the lower bearing seal assembly 91 and the flange 87. The plugs 105 are employed to removably seal the oil fill passageways 103. The upper annular oil chamber 106, which is the annular space between the upper bearing seal assembly 89 and the lower bearing seal assembly 91, is also filled with oil under pressure. The upper bearing seal assembly 89 is positioned below the lower end of the flow collar 66, forming an annular pressure equalization chamber 107 therebetween. A plurality of pressure equalization holes 108 extend radially through the rotary shaft 68 to provide fluid communication between the chamber 107 and the axial mud flow passageway 74 in the rotary shaft 68 so that the upper end of the upper bearing assembly 89 is subjected to the pressure of the mud flowing through the shaft passageway 74. Each of the upper and lower bearing seal assemblies 89 and 91 is slidable along the rotary shaft 68, so that the mud pressure is applied to the oil in the lower oil chamber 104.

Figure 2C:
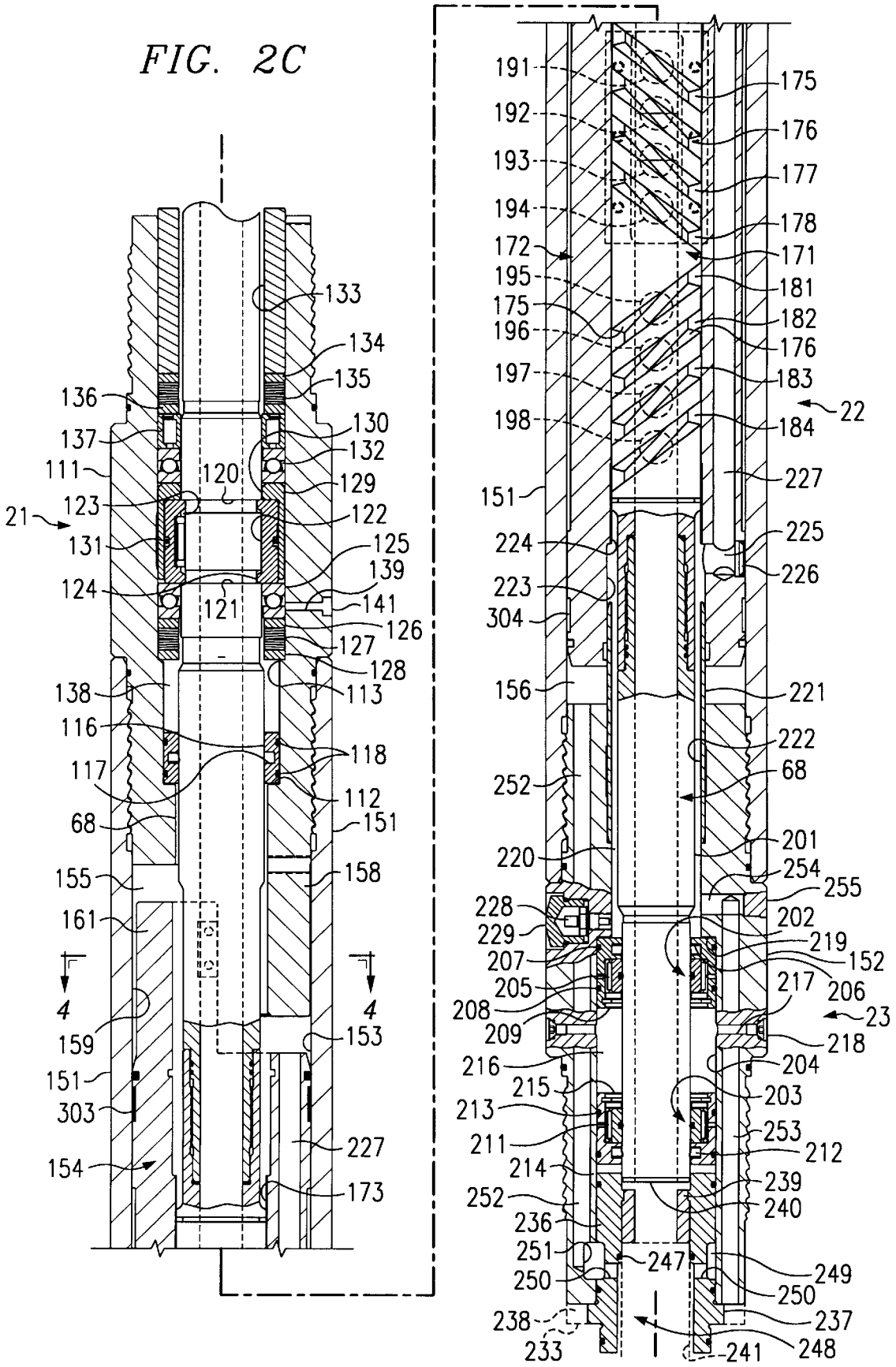
FIG. 2C is a cross-sectional view, taken along the longitudinal axis, of the compressor module of FIG. 1, comprising an anchor segment, an oscillator segment, and a connector segment.

Referring to FIG. 2C, the upper end of the tubular housing 111 of the anchor segment 21 has a reduced diameter and is externally threaded for being connected to the internally threaded box 109 at the lower end of the housing 85. The inner wall of the tubular housing 111 has a reduced diameter at the lower end portion of the housing ill, forming a lower, internal, upwardly facing, annular shoulder 112, and an intermediate diameter at an intermediate portion of the housing 111, forming an upper, internal, upwardly facing annular shoulder 113. The shoulder 112 confronts the lower end of the upper oscillator seal housing 116, and the external diameter of the upper oscillator seal housing 116 is slightly less than the outer diameter of the upwardly facing shoulder 112 and is greater than the inner diameter of the upwardly facing shoulder 112, so that the seal housing 116 is supported by the lower shoulder 112 of the housing 111. The seal housing 116 contains an annular seal 117, positioned between the seal housing 116 and the external surface of the rotary shaft 68, and a pair of O-rings 118, positioned between the seal housing 116 and the internal surface of the housing 111, thus effectively providing a fluid seal between the rotary shaft 68 and the housing 111.

A portion of the rotary shaft 68, radially adjacent an upper portion of the anchor housing 111, is provided with a pair of circumferentially extending grooves 120 and 121, spaced apart from each other along the longitudinal axis of the rotary shaft 68. An annular thrust ring 122 has upper and lower inwardly directed flanges 123 and 124, which extend radially inwardly and engage the grooves 120 and 121, respectively, 60 that the thrust ring 122 is secured to the rotary shaft 68.

A lower oscillator annular thrust bearing 125 is positioned coaxially with the rotary shaft 68 immediately below the thrust ring 122. An upper bearing spring annular spacer 126, a stack 127 of a plurality of Bellville washers, and a lower bearing spring annular spacer 128 are, in the order recited, positioned coaxially with the rotary shaft 68 between and in contact with the thrust bearing 125 and the upper, upwardly facing shoulder 113, with the Bellville washers 127 being in compression.

An annular thrust ring retainer 129 is positioned outwardly of and coaxially with the thrust ring 122, with the retainer 129 having a flange 130 which extends radially inwardly over and in contact with the top end of the thrust ring 122. An O-ring 131 is positioned between the inner surface of the retainer 129 and the outer surface of the thrust ring 122. An upper oscillator annular thrust bearing 132 is positioned coaxially with the rotary shaft 68 immediately above the thrust ring retainer 129. An oscillator shaft thrust bearing spacer 133 is positioned coaxially with the rotary shaft 68, with the upper end of the spacer 133 being maintained in contact with the lower surface of the flange 87 of the housing 85 by an upper bearing spring annular spacer 134, a stack 135 of a plurality of Bellville washers, a lower bearing spring annular spacer 136, and an upper oscillator shaft radial bearing 137, which are, in the order recited, positioned coaxially with the rotary shaft 68 between and in contact with the lower end of the thrust bearing spacer 133 and the upper end of the upper oscillator annular thrust bearing 132, with the Bellville washers 135 being in compression. The Bellville washers 127 and 135 preload the bearings 125 and 132 under a predetermined constant load.

The inner diameter of the housing member 111 between the upwardly facing shoulders 112 and 113 is substantially greater than the external diameter of the radially adjacent portion of the rotary shaft 68, and the longitudinal length of this intermediate portion of the housing 111 is substantially greater than the longitudinal length of the upper oscillator seal housing 116 so as to form an annular oil reservoir 138. A passageway 139 is provided in the wall of the housing 111 for the introduction of oil into the oscillator annular thrust bearing 125 and the oil reservoir 138. A plug 141 is provided to removably seal the passageway 139. The reservoir 138 is fluidly connected to the cavity 88 through the annular clearances between the rotary shaft 68 and the spacers 126, 128, the Bellville springs 127, the spacers 134, 136, the Bellville springs 135, and the spacers 133, and between the retainer 129 and the housing 111, and through the bearings 125, 132, and 137. Thus, the mud pressure in the annular cavity 107 is applied to the oil in the reservoir 138, thereby providing an equalization of the mud pressure and the oil pressure.

The lower end of the housing 111 of the anchor segment 21 has a reduced external diameter portion with external threads for engagement with the internally threaded box of the upper end of tubular housing 151 of the oscillator segment 22. The lower end of the housing 151 is a box having internal threads for engaging with the external threads on the reduced external diameter portion of the upper end of the housing 152 of the connector segment 23. The space between the housing 151 and the rotary shaft 68 is in the form of an elongated annular compartment 153 having a longitudinal axis which is coincident with the longitudinal axis of the rotary shaft 68. An annular compressor piston 154, having an internal diameter only slightly larger than the external diameter of the adjacent portion of the rotary shaft 68, an external diameter only slightly smaller than the internal diameter of the radially adjacent portion of the housing 151, and a longitudinal length substantially less than the longitudinal length of the elongated compartment 153, is positioned about and coaxially with the rotary shaft 68 for reciprocating motion within the elongated compartment 153 along the longitudinal axis of the elongated compartment 153. The compressor piston 154 divides the elongated compartment 153 into an upper fluid compression chamber 155 and a lower fluid compression chamber 156, with the compression chambers 155 and 156 being substantially fluidly isolated from each other within the elongated compartment 153 by the presence of the compressor piston 154.

Figure 4:
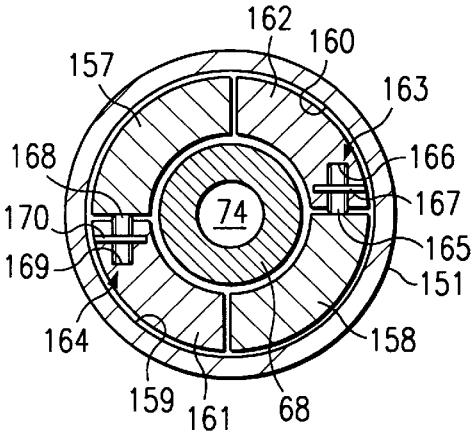
FIG. 4 is a cross-sectional view through the upper portion of the compressor piston of FIG. 1, illustrating the anti-rotation structure.
Figure 5:
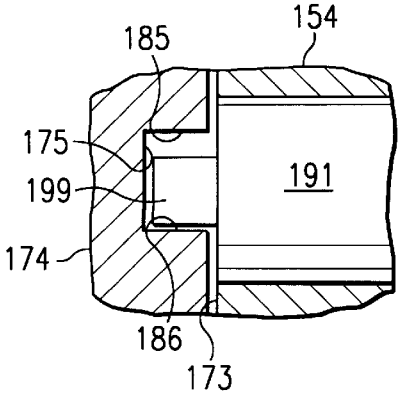
FIG. 5 is an enlarged detail view of a portion of the compressor piston of FIG. 1, illustrating the engagement between a roller and an endless groove.

Referring to FIGS. 2C and 4, the annular housing 111 has two downwardly extending arcuate segments 157 and 158, each being slightly less than 90° in arcuate length and being circumferentially separated from each other by first and second arcuate spaces 159 and 160, with each of the arcuate spaces 159 and 160 having an arcuate length of slightly more than 90°. The upper end of the compressor piston 154 is in the form of two upwardly extending arcuate segments 161 and 162, each being slightly less than 90° in arcuate length and being circumferentially spaced apart from each other by slightly more than 90°, so that the arcuate segment 161 of the compressor piston 154 slidably fits within the first arcuate space 159 between the arcuate segments 157 and 158 of the housing 111, while the arcuate segment 162 of the compressor piston 154 slidably fits within the second arcuate space 160 between the arcuate segments 157 and 158 of the housing 111. As the orientation of the segments 157, 158, 161, and 162 in a plane perpendicular to the longitudinal axis of the drill apparatus 10 is readily apparent in FIG. 4, the cross-sectional view in FIG. 2C of these elements has been modified from a 180° view to a 90° view in order to show the orientation along the longitudinal axis of the drill apparatus 10 of one of the downwardly extending segments 158 and one of the upwardly extending segments 161.

The longitudinal length of each of the arcuate segments 157, 158, 161, and 162 is sufficiently long so that the compressor piston 154 can move to its downwardmost position in the elongated compartment 153 and the upper end portions of the arcuate segments 161 and 162 of the compressor piston 154 will still be within the spaces 159 and 160 between the arcuate segments 157 and 158 of the housing 111. This construction permits the longitudinal movement of the compressor piston 154 with respect to the housing 111, while preventing the compressor piston 154 from rotating with respect to the housings 111 and 151. While the invention has been illustrated with two arcuate segments 157 and 158 on the housing 111 and two arcuate segments 161 and 162 on the compressor piston 154, any suitable number can be employed.

However, the utilization of at least two arcuate segments on each of the housing 111 and the compressor piston 154 does reduce the wear on the bearing surfaces as well as reduce the loading on the anti-rotation bearings and the oscillator support bearings.

A first anti-rotation bearing 163 is positioned at the interface between the confronting faces of the arcuate segments 158 and 162, while a second anti-rotation bearing 164 is positioned at the interface between the confronting faces of the arcuate segments 157 and 161. The bearing 163 comprises a pair of rollers 165 positioned, one above the other, in a vertically extending slot 166 in the arcuate segment 160, with each roller 165 being rotatably mounted on a pin 167 which is secured in the arcuate segment 160, so that each roller 165 readily rolls on the confronting surface of the arcuate segment 158. The bearing 164 comprises a pair of rollers 168 positioned, one above the other, in a vertically extending slot 169 in the arcuate segment 161, with each roller 168 being rotatably mounted on a pin 170 which is secured in the arcuate segment 161, so that each roller 168 rolls on the confronting surface of the arcuate segment 157. Thus, the anti-rotation bearings 163 and 164 are positioned 180° apart, so as to balance the moments created in the compressor piston 154 by the rotation of the rotary shaft 68. While the bearings 163 and 164 have been illustrated as anti-friction bearings, other suitable bearings, e.g., sliding pad bearings, can be employed.

The compressor piston 154 and an intermediate longitudinal segment 171 of the rotary shaft 68 within the elongated compartment 153 serve as components of a mechanical oscillator 172, which converts the rotary motion of the rotary shaft 68 into a reciprocating motion of the compressor piston 154.

The compressor piston 154 is an annular piston having an inner annular wall 173. The intermediate longitudinal segment 171 of the rotary shaft 68 has an enlarged external diameter which is only slightly less than the internal diameter of the compressor piston 154. The shaft segment 171 has a first, upper set of downwardly inclined endless grooves or skewed undercuts 175, 176, 177, and 178 in its outer periphery, spaced apart from each other along the longitudinal axis of the rotary shaft 68, and a second, lower set of upwardly inclined endless grooves 181, 182, 183, and 184 in its outer periphery, spaced apart from each other along the longitudinal axis of the rotary shaft 68. Each endless groove 175-178 and 181-184 is in the form of a smoothly curved closed loop. Each of the endless grooves of the first and second sets has an upper side wall 185 and a lower side wall 186. A first, upper set of roller elements 191, 192, 193, and 194, and a second, lower set of roller elements 195, 196, 197, and 198 are mounted in the inner wall 173 of the compressor piston 154, with each of the upper set of roller elements 191–194 having a roller 199 projecting radially inwardly toward the longitudinal axis of the rotary shaft 68 and rotatably positioned in a respective one of the upper set of downwardly inclined endless grooves 175–178, and each of the lower set of roller elements 195–198 having a roller 199 projecting radially inwardly toward the longitudinal axis of the rotary shaft 68 and rotatably positioned in a respective one of the lower set of upwardly inclined endless grooves 181–184. The dimension of each roller 199 in a direction parallel to the longitudinal axis of the rotary shaft 68 is less than the corresponding dimension of the respective endless groove in which the roller 199 is positioned, whereby the roller 199 of each of the upper set of roller elements 191–194 engages the lower side wall 186 of the respective one of the upper set of downwardly inclined endless grooves 175–178 only during an upward motion of the compressor piston 154 and the roller 199 of each of the lower set of roller elements 195–198 engages the upper side wall 185 of the respective one of the lower set of upwardly inclined endless grooves 181–184 only during a downward motion of the compressor piston 154. Each of the roller elements 191–198 can be provided with suitable anti-friction bearings for the axle of the respective roller 199. The anti-friction bearings can include both ball bearings and needle bearings, wherein the ball bearings are disposed adjacent the roller end of the axle and the needle bearings are disposed adjacent the remote end of the axle. The continuous rotation of the rotary shaft 68 by the drill string in a single direction causes the compressor piston 154 to repeatedly cycle through its reciprocating movements within the elongated compartment 153 along the longitudinal axis of the elongated compartment 153, with one complete revolution of the rotary shaft 68 causing one complete cycle of the compressor piston 154. The upper set of roller elements 191, 192, 193, and 194 can be mounted in a first carrier strip, while the lower set of roller elements 195, 196, 197, and 198 can be mounted in a second carrier strip, to facilitate the installation and removal of each set of the roller elements as a unit in the wall of the compression piston 154. The two sets of roller elements can be positioned on opposite sides of the rotary shaft 68.

The upper end of a lower longitudinal segment 201 of the rotary shaft 68 is threadedly connected to the lower end of the intermediate segment 171 of the rotary shaft 68. An upper seal bearing assembly 202 and a lower seal bearing assembly 203 are positioned coaxially with the shaft segment 201, between the shaft segment 201 and the inner wall 204 of the housing 152 of the connector segment 23. The upper seal bearing assembly 202 comprises an upper shaft annular bearing assembly 205, an upper shaft annular seal 206, two O-rings 207 and 208 mounted between the upper shaft annular bearing assembly 205 and the housing 152, and a retaining ring 209. The lower bearing seal assembly 203 comprises a lower shaft annular bearing assembly 211, a lower shaft annular seal 212, and two O-rings 213 and 214 mounted between the lower shaft annular bearing assembly 203 and the housing 152, and a retaining ring 215.

The upper seal bearing assembly 202 and the lower seal bearing assembly 203 are spaced apart along the longitudinal axis of the housing 152 so as to form an annular oil chamber 216 therebetween. A plurality of oil fill passageways 217 is provided in the wall of the housing 152 in order to permit oil to be injected under pressure into the annular oil chamber 216. Plugs 218 are employed to removably seal the oil fill passageways 217.

The upper bearing seal assembly 202 is positioned against a downwardly facing annular shoulder 219 in the inner wall 204 of the housing 152, so that the annular fluid passageway 220 formed between the inner wall 204 of the housing 152 and the portion of the shaft segment 201 above the shoulder 219 and below the lowermost groove 184 is isolated from the oil chamber 216. A cylindrical tube 221 is positioned exteriorly of and coaxially with the shaft segment 201 with its lower end being sealingly mounted in an annular recess 222 in the upper end of housing 152, while its upper end telescopes in an annular recess 223 in the inner wall surface 224 of a lower portion of the compressor piston 154. The internal diameter of the tube 221 is slightly larger than the external diameter of the radially adjacent portion of the shaft segment 201 s0 that the annular fluid passageway 220 extends upwardly to the annular recess 223. The axial length of the recess 223 and the axial length of the tube 221 are such that during operation of the compressor piston 154 at least the upper end of the tube 221 is always within the recess 223 in sealing engagement with the compressor piston 154, thereby isolating the fluid passageway 220 from the lower fluid chamber 156, while permitting the compressor piston 154 to freely move through its reciprocating motions. A passageway 225 is formed in the wall of the compressor piston 154 so as to extend radially outwardly from an upper end portion of the recess 223, with the outer end of passageway 225 being closed by a plug 226. A longitudinal passageway 227 is formed within the wall of the compressor piston 154 so as to extend parallel to the longitudinal axis of the compressor piston 154 from the radial passageway 225 to the upper end portion of the compressor piston 154 so as to provide fluid communication between the upper fluid compression chamber 155 and the fluid passageway 220. A gas charge valve 228 is positioned in the wall of the housing 152 in communication with the fluid passageway 220 so that the fluid compression chamber 155 and the passageways 220 and 227 can be filled with a gas under superatmospheric pressure. A valve cap 229 is mounted over the valve 228 to protect the valve 228.

Figure 2D:
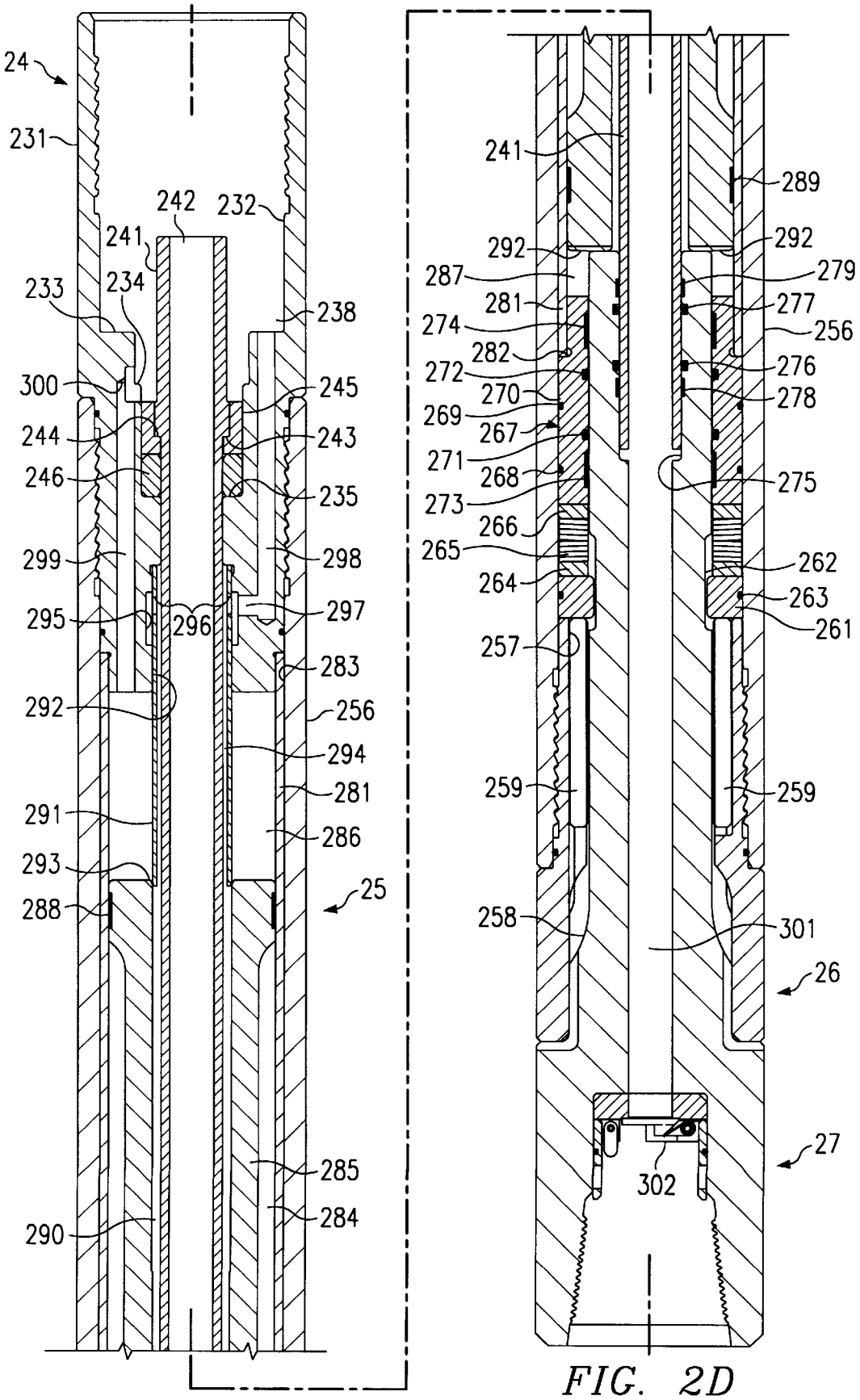
FIG. 2D is a cross-sectional view, taken along the longitudinal axis, of the impact module of FIG. 1, comprising a gas communication segment, an impact piston segment, a chuck, and a bit adapter.

Referring to FIGS. 2C and 2D, the bottom end portion of the housing 152 of the connector segment 23 has a reduced external diameter with external threads which mate with the internal threads in the box at the upper end of the housing 231 of the fluid communication segment 24. The inner wall 232 of the housing 231 has an upper upwardly facing annular shoulder 233, an intermediate upwardly facing annular shoulder 234, and a lower upwardly facing annular shoulder 235. An annular bearing seal retainer 236, which is positioned in the lower end portion of the housing 152 and in the upper end portion of the housing 231, has a radially outwardly extending flange 237, the upper annular surface of which engages the bottom end of the housing 152 and the lower annular surface of which engages the upper shoulder 233. Thus, the axial position of the bearing seal retainer 236 is firmly fixed when the housings 152 and 231 are assembled together. The external diameter of the annular flange 237 is less than the outer diameter of the upper shoulder 233, forming an annular cavity 238 between the lower end of the housing 152 and the upper shoulder 233. An annular bushing 239 is positioned coaxially within the longitudinal passageway through the retainer 236, with the inner diameter of the bushing 239 being smaller than the external diameter of the bottom end 240 of the rotary shaft 68, so that the bottom end portion of the rotary shaft 68 is positioned within the portion of the retainer 236 above the bushing 239 so that the rotary shaft 68 can rotate with respect to the bushing 239.

The top end portion of a stationary tubular shaft 241 is positioned within the portion of the retainer 236 below the bushing 239, so that the stationary tubular shaft 241 is coaxial with the rotary shaft 68, with the axial opening in the bushing 239 providing uninterrupted communication between the axial passageway 74 in the rotary shaft 68 and the axial passageway 242 in the stationary tubular shaft 241. The stationary shaft 241 has a downwardly facing external annular shoulder 243 which mates with an upwardly facing internal annular shoulder 244 of the annular seating element 245. A compression ring 246 is positioned between the bottom of the seating element 245 and the lower upwardly facing annular shoulder 235, thereby pressing the upper end of the stationary shaft 241 into sealing engagement with the O-ring 247 located in the inner wall of the annular bearing seal retainer 236 just below the bushing 239. The diameter of the inner wall of the annular bearing seal retainer 236 below the O-ring 247 is enlarged so as to provide an annular gap 248 between the external surface of the stationary shaft 241 and the inner wall of the lower portion of the annular bearing seal retainer 236. An annular groove 249 is formed in the outer periphery of the annular bearing seal retainer 236, and a plurality of passageways 250 extend radially inwardly from the annular groove 249 to the annular gap 248. An arcuate slot 251 is formed in the inner wall of the housing 152 so as to confront a portion of the annular groove 249. A passageway 252 is formed within the wall of the housing 152 to extend parallel to the longitudinal axis of the rotary shaft 68 from the arcuate slot 251 to the top end of the housing 152, and thereby provide fluid communication between the fluid compression chamber 156 and the annular gap 248. A passageway 253 is formed within the wall of the housing 152 to extend parallel to the longitudinal axis of the rotary shaft 68 from the annular gap 238 to a radially extending passageway 254. The outer end of the radial passageway 254 is closed by a plug 255, while the inner end of the radial passageway is open to the annular gas passageway 220, thereby providing fluid communication between the upper fluid compression chamber 155 and the annular gap 238.

Referring to FIG. 2D, the bottom end portion of the housing 231 of the fluid communication segment 24 has a reduced external diameter with external threads which mate with the internal threads in the box at the upper end of the housing 256 of the impact piston segment 25. The bottom end portion of the housing 256 of the impact piston segment 25 is a box having internal threads which mate with the external threads on the reduced external diameter upper portion of the chuck 26 to secure the chuck 26 to the housing 256. The chuck 26 has a plurality of longitudinally extending grooves 257 in its inner surface, with each groove 257 confronting a longitudinally extending groove 258 in the external surface of an intermediate portion of the drill bit adapter 27. Each pairing of a groove 257 and a groove 258 is provided with an elongated drive pin 259, whereby the rotation of the housing 256 by the drill string causes the corresponding rotation of the chuck 26 and the drill bit adapter 27, while the drill bit adapter 27 can move upwardly and downwardly along the longitudinal axis of the drill assembly with respect to the chuck 26. The drill bit adapter 27 is positioned coaxially within the chuck 26 and the housing 256 and extends upwardly beyond the top end of the chuck 26 into the housing 256. An annular retainer ring 261 for the drill bit adapter 27 is positioned on the upper end of the chuck 26 and extends radially inwardly into a circumferentially extending annular groove 262 formed in the exterior surface of the drill bit adapter 27. The length of the annular groove 262, parallel to the longitudinal axis of the drill assembly, is substantially greater than the corresponding longitudinal length of the retainer ring 261, thereby permitting the drill bit adapter 27 to move downwardly until the upper surface of the retainer ring 261 contacts the upper side wall of the annular groove 262. An O-ring 263 is positioned between the exterior surface of the retainer ring 261 and the inner wall of the housing 256. A lower annular spacer 264, a plurality of Bellville washers 265, and an upper annular spacer 266 are positioned coaxially with the drill bit adapter 27 between the retainer ring 261 and the lower end of the bit adaptor annular bearing seal assembly 267. Two O-rings 268 and 269 are positioned between the exterior cylindrical surface of the body 270 of the bearing seal assembly 267 and the inner wall of housing 256 to form a fluid seal therebetween. The seals 271 and 272 are spaced apart along the longitudinal axis of the drill bit assembly between a lower wear ring 273 and an upper wear ring 274, with the elements 271–274 being positioned between the inner surface of the body 270 of the bearing seal assembly 267 and the external surface of the upper portion of the drill bit adapter 27 to form a fluid seal therebetween. The lower end of the stationary tubular shaft 241 extends into an annular recess 275 in the top end portion of the drill bit adapter 27. The seals 276 and 277 are spaced apart along the longitudinal axis of the drill bit assembly between a lower wear ring 278 and an upper wear ring 279, with the elements 276–279 being positioned between the inner cylindrical surface of the recess 275 in the drill bit adapter 27 and the external surface of the lower portion of the tubular stationary shaft 241 to form a fluid seal therebetween.

A cylindrical annular wear sleeve 281 is positioned coaxially with housing 256 with the exterior cylindrical surface of the wear sleeve 281 being in contact with the interior surface of the housing 256, with the lower end of the wear sleeve 281 extending into an annular recess 282 in the outer circumference in the top end portion of the body 270 of the bearing seal assembly 267, and with the upper end of the wear sleeve 281 extending into an annular recess 283 in the outer circumference in the bottom end portion of the housing 231 of the fluid communication segment 24. The interior of the wear sleeve 281 between the top end of the body 270 of the bit adaptor annular bearing seal assembly 267 and the bottom end of the housing 231 of the fluid communication segment 24 constitutes an elongated compartment 284. A hammer piston 285, having an internal diameter larger than the external diameter of the adjacent portion of the stationary shaft 241, an external diameter only slightly smaller than the internal diameter of the radially adjacent portion of the wear sleeve 281, and a longitudinal length substantially less than the longitudinal length of the elongated compartment 284, is positioned about and coaxially with the stationary shaft 241 for reciprocating motion within the elongated compartment 284 along the longitudinal axis of the elongated compartment 284. The hammer piston 285 divides the elongated compartment 284 into an upper hammer piston fluid drive chamber 286 and a lower hammer piston fluid drive chamber 287, with the drive chambers 286 and 287 being substantially fluidly isolated from each other within the elongated compartment 284 by the presence of the hammer piston 285. The hammer piston 285 is free floating, i.e., its movements within the compartment 284 are determined only by the fluid pressures in chambers 286 and 287 as the hammer piston 285 is not mechanically connected to any other mechanical component, e.g., the drill bit adapter 27. An upper wear ring 288 is provided in the external periphery of the top end portion of the hammer piston 285, while a lower wear ring 289 is provided in the external periphery of the bottom end portion of the hammer piston 285, in order to provide replaceable bearing surfaces for sliding contact between the external surface of the hammer piston 285 and the internal surface of the wear sleeve 281.

The internal diameter of the hammer piston 285 is sufficiently larger than the external diameter of the adjacent portion of the stationary shaft 241 so as to form an annular passageway 290 extending from the bottom end of the hammer piston 285 to the top end of the hammer piston 285. A plurality of grooves are formed in the bottom end of the hammer piston 285 so as to extend radially outwardly from the annular passageway 290 so as to provide fluid communication from the annular passageway 290 to the lower hammer piston chamber 287 even when the bottom end of the hammer piston 285 is positioned on the upper end of drill bit adapter 27. Thus, the lower end of passageway 299 constitutes a first compressor port in the upper hammer piston chamber 286, while the lower end of the passageway 290 constitutes a second compressor port in the lower hammer piston chamber 287, such that the compressor produces a high fluid pressure in the first compressor port and the upper hammer piston chamber 286 and a low fluid pressure in the second compressor port and the lower hammer piston chamber 287 during a first or impact half cycle of operation of the compressor, and the compressor produces a low fluid pressure in the first compressor port and the upper hammer piston chamber 286 and a high fluid pressure in the second compressor port and the lower hammer piston chamber 287 during a second or retraction half cycle of operation of the compressor.

Figure 6:
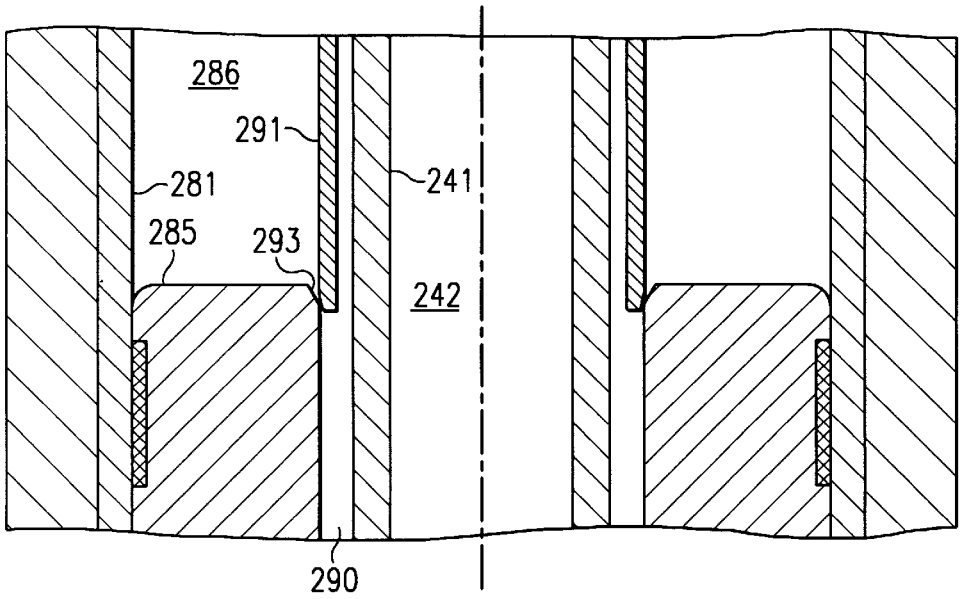
FIG. 6 is an enlarged detail view of a portion of the impact piston segment of the impact module of FIG. 1.

A cylindrical tube 291 is positioned exteriorly of and coaxially with the stationary shaft 241 with the upper end of the tube 291 being sealingly mounted in an annular recess 292 in the lower end of housing 152, while its lower end telescopes into the top end portion of the annular passageway 290 between the hammer piston 285 and the stationary shaft 241. As shown in FIG. 6, the hammer piston 285 has a chamfer 293 at the junction of the top end surface of the hammer piston 285 and the top end of the inner wall surface of the hammer piston 285. The chamfer 293 is in the form of a downwardly and inwardly extending surface which serves to guide the bottom end of the tube 291 into the annular passageway 290. The outer bottom edge portion of the tube 291 can also be provided with a mating chamfer. The radial thickness of the tube 291 is less than the radial dimension of the passageway 290, while the external diameter of the tube 291 is substantially equal to the internal diameter of the hammer piston 285 so that the tube 291 can readily enter the opening in the top end of the hammer piston 285 and thereby prevent fluid communication between the passageway 290 and the upper hammer piston chamber 286 while the tube 291 is engaged with the hammer piston 285. The internal diameter of the tube 291 is slightly larger than the external diameter of the radially adjacent portion of the stationary shaft 241 to form an annular fluid passageway 294 extending upwardly from the passageway 290 to the top end of the tube 291. An annular groove 295 is formed in the inner surface of the lower portion of the housing 231 radially adjacent an upper portion of the tube 291. A plurality of holes 296 are formed in the tube 291 to provide fluid communication between the annular passageway 290 and the annular groove 295. A radial passageway 297 is formed in the wall of the housing 231 so as to extend radially outwardly from the annular groove 295 to the lower end of a longitudinal passageway 298 which is formed in the wall of the housing 231 so as to extend parallel to the longitudinal axis of the drill assembly 10 from the radial passageway 297 to open in the shoulder 233, thus providing fluid communication between the annular cavity 238, defined by the housing 152 and the shoulder 233, and the lower hammer piston drive chamber 287. A longitudinal passageway 299 is formed in the wall of the housing 231 so as to extend parallel to the longitudinal axis of the drill assembly 10 from the bottom end of the housing 231 to an arcuate slot 300 formed in the inner surface of the housing 231 so as to extend above and below the shoulder 234, thus providing fluid communication between the annular passageway 248, defined by the interior surface of the annular bearing seal retainer 236 and the exterior surface of the top end of the stationary shaft 241, and the upper hammer piston drive chamber 286.

In operation, the drill assembly 10 is connected to the bottom end of a drill string and lowered into the borehole until the drill 14 rests on the bottom of the borehole. The drill string is then rotated to cause a corresponding rotation of the drill assembly 10, including the drill bit 14, thereby performing rotary drilling.

The drilling mud is passed downwardly through a drill string into and through axial passageways 34, 36, and 35 in the backhead 15 to the inlet 46 of the mud motor 40. One portion of the drilling mud passes between the stator 41 and the rotor 42, while the remainder, if any, of the drilling mud passes through the bypass passageway 48. The two portions of the drilling mud recombine at the outlet 47 of the mud motor 40, and the combined stream of drilling mud passes through the annular space 72 defined by the universal joint assembly 60 and the housing 58. The drilling mud then passes from the annular space 72 through the passageways 71 of the flow collar 66 into the axial flow passageway 74 in the tubular rotary shaft 68. The drilling mud then passes from axial passageway 74 through the axial opening in the annular bushing 239 into the axial passageway 242 in the stationary shaft 241, then into the axial passageway 301 extending through the drill bit adapter 27, and then through a float valve assembly 302, located in the bottom portion of the drill bit adapter 27, to and through the drill bit 14. The exhausted drilling mud then picks up drilling debris and passes upwardly through the annular space between the borehole wall and the drill bit assembly 10 and then through the annular space between the borehole wall and the drill string.

The passage of drilling mud through the mud motor 40 causes the mud motor 40 to rotate the rotary shaft 68. As the engagement of arcuate segments 157 and 158 with arcuate segments 161 and 162 prevents the rotation of the compressor piston 154 with respect to the drill assembly 10, the rotation of the rotary shaft 68 causes the roller elements 191–198 to reciprocate the compressor piston 154.

During the impact half of the cycle of operation of the compressor piston 154, the roller elements force the compressor piston 154 to move downwardly, the gas in the lower compression chamber 156 is compressed, increasing its pressure, while the pressure of the gas in the upper compression chamber 155 is decreased. The increased gas pressure in the lower compression chamber 156 is transmitted through the longitudinal passageway 252, the arcuate slot 251, the annular groove 249, the radial holes 250, the annular passageway 248, the arcuate slot 234, and the longitudinal passageway 299 to the upper hammer piston drive chamber 286. Simultaneously, gas in the lower hammer piston chamber 287 passes upwardly through the annular passageway 290, the annular passageway 294, the radial holes 296, the annular groove 295, the radial passageway 297, the longitudinal passageway 298, the annular cavity 238, longitudinal passageway 253, radial passageway 254, annular passageway 220, radial passageway 225, and the longitudinal passageway 227 into the upper compression chamber 155, due to the reduction in the gas pressure in the upper compression chamber 155. The resulting pressure differential between the increased pressure in the upper hammer piston chamber 286 and the decreased pressure in the lower hammer piston chamber 287 causes the hammer piston 285 to move rapidly toward the anvil surface represented by the top end of the drill bit adapter 27, striking the anvil surface, and transmitting an impact force through the drill bit adapter 27 to the drill bit 14. Thus, the system is designed for the hammer piston 285 to strike the anvil surface of the drill bit adapter 27 once for each revolution of the rotary shaft 68.

The length of the axial motion of the hammer piston 285, during normal operations with the drill bit 14 in contact with the borehole bottom, and the axial length of the tube 291 below the bottom end of the housing 231 are selected so that during such normal operations of the compressor piston 154, at least the lower end of the tube 291 is always within the annular passageway 290 in sealing engagement with the hammer piston 285, permitting the compressor piston 154 to freely move through its reciprocating motions while isolating the fluid passageway 290 from the upper hammer piston chamber 286, until just immediately prior to the bottom end of the hammer piston 285 striking the anvil surface at the top end of the drill bit adapter 27, at which time a small clearance is established between the bottom end of the telescoping tube 291 and the chamfer 293. This clearance permits a small amount of fluid communication between the upper hammer piston drive chamber 286 and the passageway 290. As the pressure in the lower hammer chamber 287 is greater than the pressure in the upper hammer chamber 286 at the moment of the impact of the hammer piston 285 against the anvil surface at the top end of the drill bit adapter 27, this permits the pressure in the lower hammer chamber 287 to establish a minimum initial pressure in the upper hammer piston chamber 286 at the moment of impact of the hammer piston 285 against the drill bit adapter 27. This minimum initial pressure in the upper hammer piston chamber 286 prevents overstroking and "floating" of the hammer piston 285 during the retraction stroke, which would result in a loss of energy.

During the retraction half of the cycle of operation of the compressor piston 154, the roller elements force the compressor piston 154 to move upwardly, and the gas in the upper compression chamber 155 is compressed, increasing its pressure, while the pressure of the gas in the lower compression chamber 156 is decreased. The increased gas pressure in the upper compression chamber 155 is transmitted through the longitudinal passageway 227, the radial passageway 225, the annular passageway 220, the radial passageway 254, the longitudinal passageway 253, the annular cavity 238, the longitudinal passageway 298, the radial passageway 297, the annular groove 295, the radial holes 296, the annular passageway 294, the annular passageway 290, and the grooves 292 into the lower hammer piston drive chamber 287. Although there is initially a clearance between the bottom end of the tube 291 and the chamfer 293 at the top of the hammer piston 285, the gas flow through the clearance is small compared to the gas flow through the annular passageway 290 into the lower hammer piston drive chamber 287 so that the hammer piston 285 is quickly raised to the point where the clearance is eliminated, and thereafter the total flow of the higher pressure gas goes to the lower hammer piston drive chamber 287. Simultaneously, gas in the upper hammer piston chamber 286 passes upwardly through the longitudinal passageway 299, the arcuate slot 234, the annular passageway 248, the radial holes 250, the annular groove 249, the arcuate slot 251, and the longitudinal passageway 252, to the lower compression chamber 156, due to the reduction in the gas pressure in the lower compression chamber 156. The resulting pressure differential between the decreased pressure in the upper hammer piston chamber 286 and the increased pressure in the lower hammer piston chamber 287 causes the hammer piston 285 to move rapidly upwardly. The range of motion of the hammer piston 285 is selected so that the upward motion of the hammer piston 285 during the retraction half cycle terminates without the top of the hammer piston 285 reaching the bottom end of the housing 231.

When the drill bit is positioned out of contact with the bottom of the borehole, the drill bit 14 and the drill bit adapter 27 move axially downwardly with respect to the remainder of the drill assembly until the upper surface of the retainer ring 261 contacts the upper side wall of the annular groove 262. This lower position of the drill bit adapter 27 permits the hammer piston 285 to move downwardly a greater distance during the next impact half of the cycle of operation of the compressor piston 154, resulting in a substantially greater clearance between the bottom end of tube 291 and the chamfer 293, to the extent that during the next retraction half cycle, this greater clearance effectively short-circuits the flow of the high pressure gas from the annular passageway 294 into the upper hammer piston drive chamber 286, preventing the raising of the hammer piston 285. Thus, the hammer piston 285 remains in this lower position until the drill bit 14 again contacts the bottom of the borehole, raising the drill bit adapter with respect to the remainder of the drill assembly 10, and thereby raising the hammer piston 285 until, upon the next retraction half cycle, the hammer piston 285 can be retracted upwardly as part of its normal operation. This permits a free circulation of the working gas in the closed fluid system without building up pressure or heat, while the drill bit 14 is not in contact with the borehole bottom.

Figure 7:
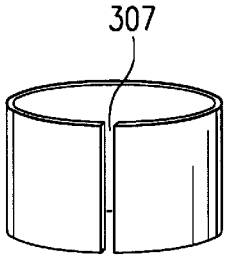
FIG. 7 is a view of an exemplary wear ring for the pistons of the embodiment of FIG. 1.

An upper annular wear ring 303 is positioned about the circumference of an upper portion of the compressor piston 154 between the compressor piston 154 and the radially adjacent portion of the inner wall of compartment 153, while a lower annular wear ring 304 is positioned about the circumference of a lower portion of the compressor piston 154 between the compressor piston 154 and the radially adjacent portion of the inner wall of compartment 153. In addition to providing replaceable wear surfaces, each of the wear rings 303 and 304 contains a longitudinally extending bleed fluid passageway therein, permitting a small flow of fluid between chambers 155 and 156 whereby the pressures in the chambers 155 and 156 can equalize when the compressor piston 154 is stationary. Similarly, the upper annular wear ring 288 is positioned about the circumference of an upper portion of the hammer piston 285 between the hammer piston 285 and the radially adjacent portion of the inner wall of compartment 284, while the lower annular wear ring 289 is positioned about the circumference of a lower portion of the hammer piston 285 between the hammer piston 285 and the radially adjacent portion of the inner wall of compartment 284. In addition to providing replaceable wear surfaces, each of the wear rings 288 and 289 contains a longitudinally extending bleed fluid passageway therein, permitting a small flow of fluid between chambers 286 and 287 whereby the pressures in the chambers 286 and 287 can equalize when the hammer piston 285 is stationary. As shown in FIG. 7, each of the wear rings 288, 289, 303, and 304 is preferably a band of sheet material formed in a circle with a gap between the two ends of the band so as to thereby provide the bleed passageway 307.

Figure 8:
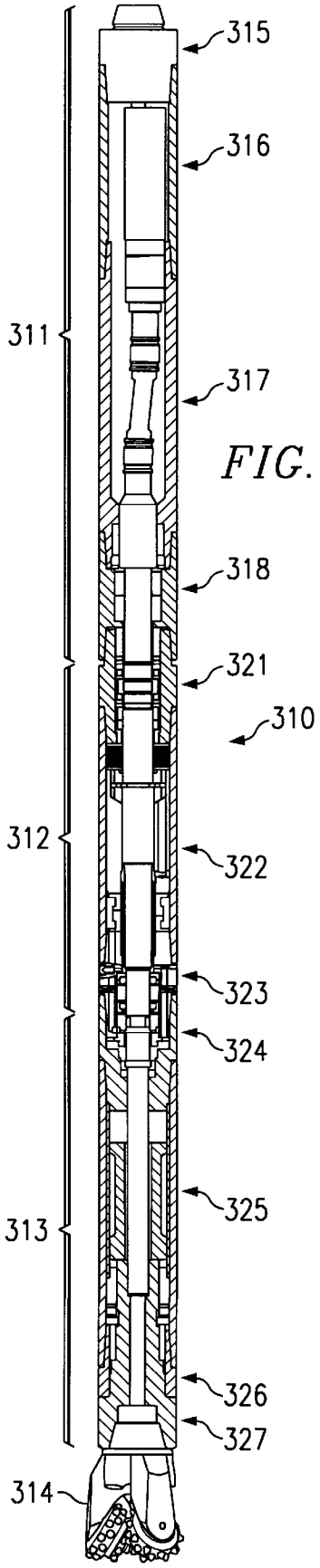
FIG. 8 is a side view of another embodiment of a drill assembly in accordance with the invention, showing the various modules connected together in sequence along the longitudinal axis of the assembly.
Figure 10:
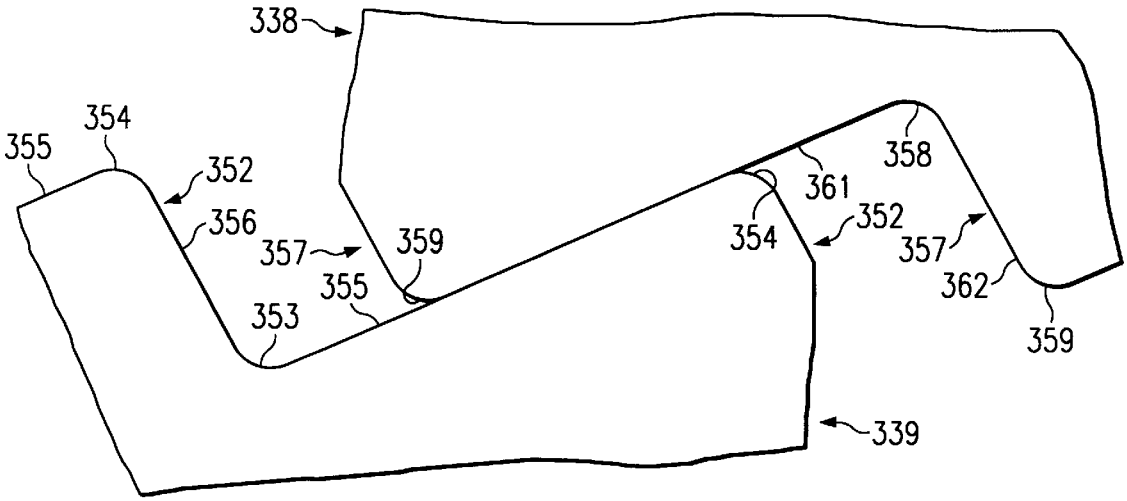
FIG. 10 is a detail view of the ratchet mechanism of the oscillator segment of FIG. 9.
Figure 9:
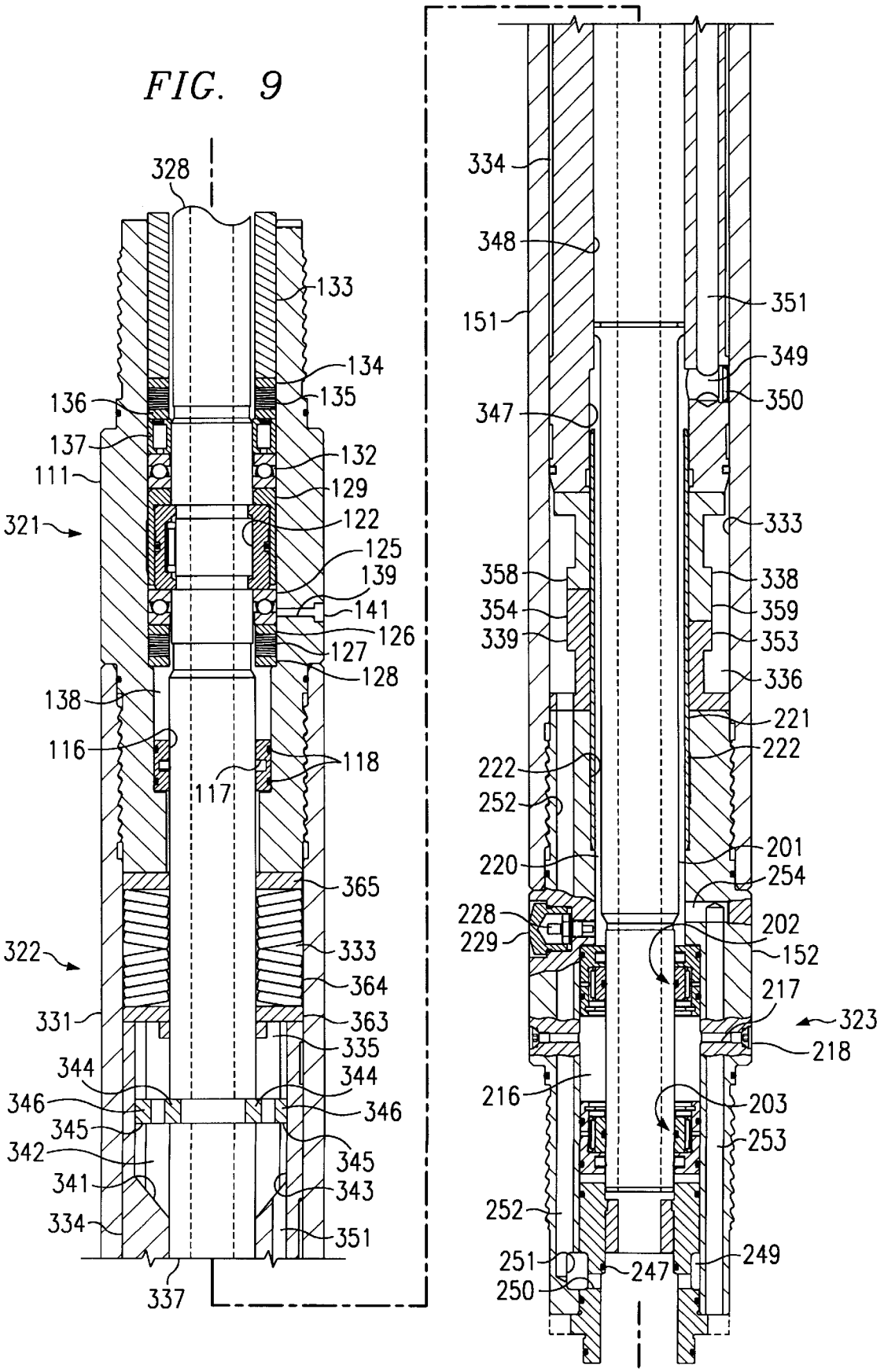
FIG. 9 is a cross-sectional view, taken along the longitudinal axis, of the compressor module of FIG. 8, comprising an anchor segment, an oscillator segment, and a connector segment.

FIGS. 8, 9, and 10 illustrate a drill assembly 310 in accordance with a second embodiment of the invention. The drill assembly 310 comprises a power module 311, a compressor module 312, an impact module 313, and a drill bit 314. The compressor module 312 comprises an anchor segment 321, an oscillator segment 322, and a connector segment 323. The impact module 313 comprises a fluid communication segment 324, an impact piston segment 325, a chuck 326, and a bit adapter 327. As the components of the drill assembly 310, other than the compressor module 312, can be the same as those of the first embodiment, their illustration and description are not repeated.

Referring to FIG. 9, the anchor segment 321 is identical to the anchor segment 21 and comprises the tubular housing 111, the annular thrust ring 122, the upper oscillator seal housing 116 with the seal 117 and the pair of O-rings 118 which provide a fluid seal between the rotary shaft 328 and the housing 111, the lower oscillator annular thrust bearing 125, the upper bearing spring annular spacer 126, the stack 127 of Bellville washers, the lower bearing spring annular spacer 128, the annular thrust ring retainer 129, the upper oscillator annular thrust bearing 132, the oscillator shaft thrust bearing spacer 133, the upper bearing spring annular spacer 134, the stack 135 of Bellville washers, the lower bearing spring annular spacer 136, the upper oscillator shaft radial bearing 137, the annular oil reservoir 138, the oil fill passageway 139, and the plug 141.

The lower end of the housing 111 of the anchor segment 321 has a reduced external diameter portion with external threads for engagement with the internally threaded box of the upper end of the tubular housing 331 of the oscillator segment 322. The lower end of the housing 331 is a box having internal threads for engaging with the external threads on the reduced external diameter portion of the upper end of the housing 152 of the connector segment 323. The connector segment 323 is identical to the connector segment 23 of the first embodiment, and comprises the upper seal bearing assembly 202, the lower seal bearing assembly 203, the annular oil chamber 216, the oil fill passageways 217, the plugs 218, the cylindrical tube 221, the gas charge valve 228, the valve cap 229, and the gas passageways 249, 250, 251, 252, 253, 254, and 220.

The space between the housing 331 and the rotary shaft 328 above the housing 331 and below the housing 111 is in the form of an elongated annular compartment 333 having a longitudinal axis which is coincident with the longitudinal axis of the rotary shaft 328. An annular compressor piston 334, having an internal diameter only slightly larger than the external diameter of the adjacent portion of the rotary shaft 328, an external diameter only slightly smaller than the internal diameter of the radially adjacent portion of the housing 331, and a longitudinal length substantially less than the longitudinal length of the elongated annular compartment 333, is positioned about and coaxially with the rotary shaft 328 for reciprocating motion within the elongated annular compartment 333 along the longitudinal axis of the elongated annular compartment 333. The compressor piston 334 divides the elongated annular compartment 333 into an upper fluid compression chamber 335 and a lower fluid compression chamber 336, with the compression chambers 335 and 336 being substantially fluidly isolated from each other within the elongated annular compartment 333 by the presence of the compressor piston 334.

The compressor piston 334, an intermediate longitudinal segment 337 of the rotary shaft 328 within the elongated compartment 333, an upper ratchet 338, and a lower ratchet 339 serve as components of a mechanical oscillator 340, which converts the rotary motion of the rotary shaft 328 into a reciprocating motion of the compressor piston 334.

The compressor piston 334 is an annular piston having an inner annular wall 341. The intermediate longitudinal segment 337 of the rotary shaft 328 has an enlarged external diameter which is only slightly less than the internal diameter of the central portion and the lower end portion of the compressor piston 334. In the upper end portion of the compressor piston 334, the inner wall 341 has an enlarged diameter to form a cavity 342. The circumferential wall of the cavity 342 has a plurality of elongated grooves 343 formed therein which are parallel to the longitudinal axis of the rotary shaft 328. An annular rotator element 344 is positioned in the cavity 342 coaxially with the rotary shaft 328 and in fixed engagement with the rotary shaft 328. The rotator element 344 has a plurality of relatively short splines 345 spaced apart about its outer periphery, with each of the splines 345 being parallel to the longitudinal axis of the rotary shaft 328 and being slidably positioned within a respective one of the elongated grooves 343. Thus, as the shaft 328 is rotated with respect to the housing 331 by the action of the mud motor, the rotator element 344 causes a corresponding rotation of the compressor piston 334 about the longitudinal axis of the shaft 328, while the splines 345 and the grooves 343 permit any movement of the compressor piston 334 with respect to the housing 331 along the axis of the rotary shaft 328. The rotator element 344 can be provided with a plurality of openings 346 extending therethrough parallel to the longitudinal axis of the shaft 328 in order to provide for pressure equalization in the cavity 342 above and below the rotator element 344.

The cylindrical tube 221 is positioned exteriorly of and coaxially with the shaft segment 337 with its lower end being sealingly mounted in an annular recess 222 in the upper end of housing 152, while its upper end telescopes in an annular recess 347 in the inner wall surface 348 of a lower portion of the compressor piston 334. The internal diameter of the tube 221 is slightly larger than the external diameter of the radially adjacent portion of the shaft segment 337 so that the annular fluid passageway 220 extends upwardly to the annular recess 347. The axial length of the recess 347 and the axial length of the tube 221 are such that during operation of the compressor piston 334 at least the upper end of the tube 221 is always within the recess 347 in sealing engagement with the compressor piston 334, thereby isolating the fluid passageway 220 from the lower fluid chamber 336, while permitting the compressor piston 334 to freely move through its reciprocating motions.

The passageway 349 is formed in the wall of the compressor piston 334 so as to extend radially outwardly from an upper end portion of the recess 347, with the outer end of passageway 349 being closed by a plug 350. A longitudinal passageway 351 is formed within the wall of the compressor piston 334 so as to extend parallel to the longitudinal axis of the compressor piston 334 from the radial passageway 349 to the cavity 342 in the upper end portion of the compressor piston 334 so as to provide fluid communication between the upper fluid compression chamber 335 and the fluid passageway 220.

Referring to FIGS. 9 and 10, the lower ratchet 339 is fixedly secured to the top end of the housing 152 of the connector segment 323, and thus is stationary with respect to the housing 331 of the oscillator segment 322, while the upper ratchet 338 is fixedly secured to the lower end of the compressor piston 334, and thus rotates with the compressor piston 334 with respect to the housing 331 of the oscillator segment 322. The lower ratchet 339 has a plurality of ratchet ramped teeth 352 which have a triangular shape and are spaced at equal intervals about the circumference of the top of the lower ratchet 339, with each ratchet tooth 352 having a root 353, a crown 354 and a long ramped surface 355 extending in a first direction from its root 353 to its crown 354 and then a short ramped surface 356 extending in the first direction from its crown 354 to the root of the adjacent tooth 352. The upper ratchet 338 has a corresponding plurality of ratchet ramped teeth 357 spaced at equal intervals about the circumference of the bottom of the upper ratchet 338, with each of the upper ratchet teeth 357 also having a root 358 and a crown 359, but with the long ramped surface 361 therebetween extending in the direction opposite to the first direction. The short ramped surface 362 between the crown 359 and the root 358 of the adjacent tooth 357 also extends in the direction opposite to the first direction.

A lower annular spacer 363, a plurality of Bellville washers 364, and an upper annular spacer 365 are stacked coaxially with the rotary shaft 328 between the top end of the compressor piston 334 and the bottom end of the housing 111, with the Bellville springs 364 being in compression such that the upper ratchet 338 is maintained in contact with the lower ratchet 339.

In operation, the drill assembly 310 is connected to the bottom end of a drill string and lowered in the borehole until the drill 314 rests on the bottom of the borehole. The drill string is then rotated to cause a corresponding rotation of the drill assembly 310, including the drill bit 314, thereby performing rotary drilling. The drilling mud is passed downwardly through a drill string to and through the mud motor and the various axial mud passageways, as in the operation of the first embodiment, to the drill bit 314.

Accordingly, as the compressor piston 334 and the upper ratchet 338 are rotated by the rotary shaft 328 during the retraction portion of the cycle of operation, the distance between the bottom of the lower ratchet 339 and the top of the upper ratchet 338 increases as the crown 359 of an upper ratchet tooth 357 moves from the root 353 of a lower ratchet tooth 352 along the long ramped surface 355 to the crown 354 of that lower ratchet tooth 352 during a first half cycle of operation. The upward movement of the compressor piston 334 compresses the Bellville washers 364, reducing the volume of the upper compression chamber 335 and thereby compressing the gas in the upper compression chamber 335. The increased gas pressure in the upper compression chamber 335 is transmitted through the longitudinal passageway 351, the radial passageway 349, and the annular passageway 220, the radial passageway 254, and the longitudinal passageway 253, and, as illustrated in FIG. 2D, through the annular cavity 238, the longitudinal passageway 298, the radial passageway 297, the annular groove 295, the radial holes 296, the annular passageway 294, the annular passageway 290, and the grooves 292 into the lower hammer piston drive chamber 287. Simultaneously, gas in the upper hammer piston chamber 286 passes upwardly through the longitudinal passageway 299, the arcuate slot 234, the annular passageway 248, the radial holes 250, the annular groove 249, the arcuate slot 251, and the longitudinal passageway 252, to the lower compression chamber 336, due to the reduction in the gas pressure in the lower compression chamber 336. The resulting pressure differential between the decreased pressure in the upper hammer piston chamber 286 and the increased pressure in the lower hammer piston chamber 287 causes the hammer piston 285 to move upwardly.

During the impact portion of the cycle of operation of the compressor piston 334, the crown 359 of each upper ratchet tooth 357 moves off of the crown 354 of a lower ratchet tooth 352 and slides down the short ramped surface 356 to the root 353 of the adjacent lower ratchet tooth 352. The angles of inclination of the ramped surfaces 355 and 356 can be the same or different from each other and can be individually selected to provide the desired rates of motion of the compressor piston 334 during each of the retraction portion and the impact portion of the cycle of operation. The removal of the ratchet mandated separation permits the Bellville washers 364 to force the compressor piston 334 to move downwardly, compressing the gas in the lower compression chamber 336, increasing its pressure, while the pressure of the gas in the upper compression chamber 335 is decreased. The increased gas pressure in the lower compression chamber 336 is transmitted through the longitudinal passageway 252, the arcuate slot 251, the annular groove 249, and the radial holes 250, and, as illustrated in FIG. 2D, through the annular passageway 248, the arcuate slot 234, and the longitudinal passageway 299 to the upper hammer piston drive chamber 286. Simultaneously, gas in the lower hammer piston chamber 281 passes upwardly through the annular passageway 290, the annular passageway 294, the radial holes 296, the annular groove 295, the radial passageway 297, the longitudinal passageway 298, the annular cavity 238, the longitudinal passageway 253, the radial passageway 254, the annular passageway 220, the radial passageway 349, and the longitudinal passageway 351 into the upper compression chamber 335, due to the reduction in the gas pressure in the upper compression chamber 335. The resulting pressure differential between the increased pressure in the upper hammer piston chamber and the decreased pressure in the lower hammer piston chamber causes the hammer piston to move rapidly toward the anvil surface represented by the top end of the drill bit adapter 27, striking the anvil surface, and transmitting an impact force through the drill bit adapter 27 to the drill bit 14.

By positioning the hammer piston and the anvil end of the drill bit adapter in a closed fluid compartment, both embodiments of the invention avoid the erosion of the impact drive components caused by sand in the drilling mud in the direct mud drive systems. By utilizing a superatmospheric gas as the fluid in the closed fluid compartment, both embodiments of the invention avoid the dissipation of the impact force caused by the immersion of the hammer piston in the drilling mud in the direct mud drive systems. While the embodiment of FIGS. 8–10 is considered to be useful, the embodiment of FIGS. 1–7 is presently preferred because the roller-oscillator avoids the excessive wear on the cam surfaces of the cam action, spring-loaded mechanical oscillator system, as well as providing a smoother operation.

With either embodiment of the invention, it is desirable to operate the hammer piston within ±10% of the natural resonant frequency of the system. There are two approaches for an analysis of the operating cycle. The first approach is to treat the system as a simple compression/expansion process in which the compressor piston moves and pressurizes a fluid which in turn causes motion of the hammer piston. However, while this approach recognizes the compressibility of the gas, it ignores the fact that the sealed chambers act like springs. The second approach also treats the system as a compression/expansion process, but recognizes the fact that the cycling of the hammer piston is actually a case of forced harmonic vibration in which the gas chamber volumes are springs, the hammer piston is a mass, and the compressor piston provides a forcing function. As such, the system will have an inherent natural resonant frequency at which the stroke and energy of the hammer piston will be at maximum levels. The relevant equations for the system spring constant k and the frequency f are:

$$k = 1.4 * P * \left( \frac{A^2}{V_r} + \frac{A^2}{V_d} \right)$$

$$f_n = C * \sqrt{\frac{k}{m}}$$

where:

k is the system spring constant, 1 bf/in,

P is the equilibrium system gas pressure, 1 bf/in$^2$,

A is the hammer piston working (pressurized) area, in$^2$, $V_r$ is the return chamber gas volume, in$^3$, $V_d$ is the drive chamber gas volume, in$^3$, f is the frequency, cycles/minute, m is the mass of the hammer piston, 1 b, and C is a coefficient to adjust for units and damping.

For the units given in the above definitions, and assuming a damping coefficient of 0.3, the approximate value of C is 214. This value of C also reflects the fact that the "working" natural frequency is approximately 20% higher than the free-cycling natural frequency due to the interruption of the free-cycling natural frequency by the hammer piston impact.

These equations were derived from basic fluid properties information and the fundamental equations for simple harmonic motion found in *Mechanical Engineering Reference Manual*, Ninth Edition, by Michael R. Lindeburg, P. E., published by Professional Publications, Inc., Belmont, Calif. 94002. These equations can be employed as basic design equations by one skilled in the art of designing impact tools. After selecting a desired operating frequency range and piston mass (based on the size of the hole to be drilled), the frequency equation is used to calculate a desired value for k. This value of k is then used iteratively to determine appropriate values of A, $V_r$, $V_d$, and P. It is obvious from the above equations that the optimum operating frequency can be easily changed by changing the equilibrium system gas pressure P before the introduction of the drill assembly into the wellbore. An increase in the equilibrium system gas pressure raises the frequency, while a decrease in the equilibrium system gas pressure lowers the frequency.

If the working fluid in the closed system is a liquid, e.g., oil, rather than a gas, the equations for the spring constant k and the natural frequency f remain essentially the same except that the factor 1.4P, in the equation for k, becomes E, where E represents the fluid bulk modulus for the given liquid (analogous to the modulus of elasticity for a solid material). Since E is a property of the fluid rather than a function of pressure, the optimum operating frequency of a liquid based system is not changed as easily as for a gas based system. The most reasonable way to vary the frequency with a liquid working fluid is by providing a means to vary the chamber volumes before the introduction of the drill assembly into the wellbore. While this is obviously more difficult than simply changing a charge gas pressure, it can be done if other considerations make the liquid based embodiment attractive.

Gas is presently preferred as the fluid for the closed system, with air and nitrogen being the preferred gases.

Once the parameters are selected for achieving normal design operation at the natural frequency, and the drill assembly is lowered downhole, the actual operation can be altered from the normal design operation by varying the mud flow rate through the drill string, and thus the revolution rate of the mud motor. This will result as a corresponding variation in the frequency of operation. However, while it is presently preferred to operate the drill assembly within ±10% of the natural frequency, operating the drill assembly within ±20% of the natural frequency can provide satisfactory results.

While running at the natural frequency creates the longest hammer piston stroke and the highest energy level, it does not guarantee that the energy will be delivered to the anvil surface of the drill bit adapter. In a closed system, the hammer piston can float into a position which allows it to cycle freely at the natural frequency without impacting on anything. A mechanism which can be used to initialize the hammer piston motion after each cycle is a momentary connection between $V_r$ and $V_d$ at the moment of impact of the hammer piston against the anvil surface of the drill bit adapter. This momentary connection causes a small amount of fluid to flow from $V_r$ to $V_d$ during each cycle, thus compensating for internal leakage and keeping the time averaged pressure in $V_d$ slightly higher than the time averaged pressure in $V_r$. This is an important factor in the delivery of impact energy to the anvil surface of the drill bit adapter.

Reasonable variations and modifications are possible within the scope of the foregoing description, the drawings and the appended claims to the invention. For example, if desired, the drill assembly can be provided with two oscillators and two fluid compressors to increase the effective compressor capacity. The rotary shaft 68 can extend all the way to the bit adapter 27, which can be positioned for rotation with respect to the housing, such that the bit adapter 27 and the drill bit 14 are rotated by the rotary shaft 68 rather than by the rotation of the drill string. A high pressure reservoir and a low pressure reservoir can be interposed between the compressor piston and the hammer piston, with the compressed working fluid from the compressor being conveyed through appropriate valving to the high pressure reservoir, and the working fluid to be compressed being withdrawn from the low pressure reservoir through appropriate valving. The working fluid from the high pressure reservoir can be directed through appropriate valving alternately to the two ends of the hammer piston, causing the hammer piston to reciprocate, with the used fluid being exhausted to the low pressure reservoir. In this latter embodiment, there is no direct relationship between the oscillator frequency and the hammer piston frequency, and the impacting piston frequency is determined by other design parameters. This latter embodiment has greater design flexibility, as the optimum impacting frequency for a particular application can be achieved without regard to the mud motor speed, but also has greater design complexity. While the invention is particularly applicable to the combination of rotary drilling and percussion drilling, it can be employed to achieve percussion drilling without the necessity of rotating the drill bit.

We claim:

1. An apparatus for operating within a borehole in an earth formation, said apparatus comprising:

an elongated housing assembly having a first end adapted to removably connect said apparatus to a pipe string;

an annular shaft rotatably mounted in said housing assembly and having a longitudinal axis;

a motor positioned in said housing assembly and adapted to rotate said shaft about the longitudinal axis of said shaft, said motor comprising:

a liquid inlet, a liquid outlet, and a stator surrounding an annular rotor positioned between said liquid inlet and said liquid outlet, said rotor having a bore and being connected to said shaft so that rotation of said rotor causes corresponding rotation of said shaft, and said liquid inlet of said motor being operably connected to said housing assembly so that a liquid from the pipe string flows into the motor whereupon a first portion of the liquid flows through the bore of the rotor and a second portion of the liquid flows between said stator and said rotor to said liquid outlet to effect rotation of said rotor with respect to said housing assembly, thereby rotating said shaft;

a choke attached to the rotor for varying the flow between the first and second portions of liquid;

an annular piston positioned within said housing assembly coaxially with said shaft for reciprocating movements of said annular piston along the longitudinal axis of said shaft, said annular piston having an inner annular wall;

a first one of said inner annular wall of said annular piston and said shaft having at least one circumferential endless groove formed therein, each endless groove being in the form of an endless loop which is inclined at an acute angle to the longitudinal axis of said shaft; and a second one of said inner annular wall of said annular piston and said shaft having at least one roller element carried thereby so that each roller element extends into a respective one of said at least one endless groove so as to engage a wall of the respective groove, so that rotation of said shaft in a first direction causes said annular piston to repeatedly cycle through its reciprocating movements.

2. Apparatus in accordance with claim 1, wherein said at least one circumferential endless groove comprises a first set of downwardly inclined endless grooves and a second set of upwardly inclined endless grooves, each of the endless grooves of said first and second sets having an upper side wall and a lower side wall; and wherein said at least one roller element comprises a first set of roller elements and a second set of roller elements with each of said first set of roller elements being positioned in a respective one of said first set of downwardly inclined endless grooves and each of said second set of roller elements being positioned in a respective one of said second set of upwardly inclined endless grooves;

whereby each of said first set of roller elements engages a side wall of the respective one of said first set of downwardly inclined endless grooves only during a downward motion of said annular piston and each of said second set of roller elements engages a side wall of the respective one of said second set of upwardly inclined endless grooves only during an upward motion of said annular piston.

3. An apparatus for operating within a borehole, said apparatus comprising:

a housing assembly, an annular shaft rotatably mounted in the housing assembly and having at least one groove formed therein, the groove circumscribing the shaft at an acute angle to the longitudinal axis of the shaft, a motor disposed in the housing assembly, the motor comprising:

a liquid inlet, a liquid outlet, and a stator surrounding a rotor disposed between the inlet and the outlet, the rotor having a bore and being coupled to the shaft so that rotation of the rotor causes rotation of the shaft, and the inlet being connected to a passageway in the housing assembly so that liquid from the pipe string is divided into a first portion of liquid which flows into the bore of the rotor, thereby bypassing the stator, and a second portion of liquid which flows through the passageway and between the rotor and stator to the outlet, a choke attached to the rotor for varying the flow between the first and second portions of liquid, an annular piston coupled to the shaft for reciprocating movements in a longitudinal direction relative to the shaft in response to rotation of the shaft, the annular piston having an inner annular wall, at least one roller element located in the inner annular wall and engaging the groove, and a drill bit operably connected to the piston for drilling in the borehole.

4. An apparatus for operating within a borehole, said apparatus comprising:

a housing assembly adapted to be connected to a pipe string, an annular shaft rotatably mounted in the housing assembly and having a first set of grooves inclined in one direction and a second set of grooves inclined in another direction, a motor disposed in the housing assembly, the motor comprising:

a liquid inlet, a liquid outlet, and a stator surrounding a rotor disposed between the inlet and the outlet, the rotor having a bore and being coupled to the shaft so that rotation of the rotor causes rotation of the shaft, and the inlet being connected to a passageway in the housing assembly so that liquid from the pipe string is divided into a first portion of liquid which flows into the bore of the rotor, thereby bypassing the stator, and a second portion of liquid which flows through the passageway and between the rotor and stator to the outlet, a choke attached to the rotor for varying the flow between the first and second portions of liquid, an annular piston coupled to the shaft for reciprocating movements in a longitudinal direction relative to the shaft in response to rotation of the shaft, a first set of roller elements engaging the first set of grooves on a stroke of the piston in a first direction, and a second set of roller elements engaging the second set of grooves during a stroke of the piston in a direction opposite the first direction, and a drill bit operably connected to the piston for drilling in the borehole.

* * * * *